US008364064B2

(12) United States Patent
Ashikawa et al.

(10) Patent No.: US 8,364,064 B2
(45) Date of Patent: Jan. 29, 2013

(54) INTERMEDIATE TRANSFER DEVICE, IMAGE FORMING APPARATUS AND SECONDARY TRANSFER METHOD

(75) Inventors: Masahiro Ashikawa, Sagamihara (JP); Takahisa Koike, Tokyo (JP); Hideyuki Takayama, Yokohama (JP); Yoshihiro Asano, Sagamihara (JP); Minoru Takahashi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 596 days.

(21) Appl. No.: 12/458,986

(22) Filed: Jul. 29, 2009

(65) Prior Publication Data

US 2010/0034565 A1 Feb. 11, 2010

(30) Foreign Application Priority Data

Jul. 30, 2008 (JP) ..... 2008-196495
Jul. 6, 2009 (JP) ..... 2009-160017

(51) Int. Cl.
*G03G 15/00* (2006.01)
*G03G 15/01* (2006.01)
*G03G 15/16* (2006.01)
*G03G 15/20* (2006.01)

(52) U.S. Cl. ..... 399/302; 399/66; 399/308; 399/388; 399/389; 399/45

(58) Field of Classification Search ..... 399/302, 399/389
See application file for complete search history.

(56) References Cited

U.S. PATENT DOCUMENTS 5,486,903 A * 1/1996 Kanno et al. ..... 399/45
5,655,176 A * 8/1997 Inoue et al. ..... 399/45
5,966,559 A * 10/1999 May et al. ..... 399/45
6,000,693 A * 12/1999 Tranquilla ..... 271/263
6,002,891 A * 12/1999 Shin ..... 399/45
6,381,423 B1 * 4/2002 Eom ..... 399/45
6,701,098 B2 * 3/2004 Pyke et al. ..... 399/45
2005/0078994 A1 * 4/2005 Suzuki ..... 399/389
(Continued)

FOREIGN PATENT DOCUMENTS

JP 04-242276 8/1992
JP 06-115752 4/1994
(Continued)

OTHER PUBLICATIONS

English language abstract of Japanese Patent Application 11-153917 submitted for JP3826573.

*Primary Examiner* — Walter L Lindsay, Jr.
*Assistant Examiner* — David Bolduc
(74) *Attorney, Agent, or Firm* — Harness, Dickey & Pierce, P.L.C.

(57) ABSTRACT

An intermediate transfer device including an intermediate transfer body having a primary transfer portion and a secondary transfer portion which bears a secondary image formed by transferring a primary image from an image bearing member; a pair of secondary transfer rollers having a secondary transfer roller and a support roller provided in contact with each other via the intermediate transfer body at the secondary transfer portion, which transfers the secondary image to a recording medium at the secondary transfer portion; a variation detection device that detects an amount of variance occurring to a transfer rotation body when the recording medium is transferred to the secondary transfer portion; and an adjustment device that adjusts the distance between the pair of the secondary transfer rollers according to the amount of variance detected by the variation detection device.

12 Claims, 20 Drawing Sheets

U.S. PATENT DOCUMENTS

| | | | | |
|---|---|---|---|---|
| 2006/0056861 | A1* | 3/2006 | Nojima | 399/16 |
| 2006/0216048 | A1* | 9/2006 | Fujii et al. | 399/45 |
| 2007/0008395 | A1* | 1/2007 | Masubuchi et al. | 347/104 |
| 2007/0110464 | A1* | 5/2007 | Nakayama et al. | 399/45 |
| 2007/0269230 | A1* | 11/2007 | Hoshino et al. | 399/45 |
| 2008/0232880 | A1* | 9/2008 | Noguchi et al. | 399/397 |
| 2009/0116860 | A1* | 5/2009 | Hoshino et al. | 399/45 |
| 2010/0074641 | A1* | 3/2010 | Takenaka | 399/66 |

FOREIGN PATENT DOCUMENTS

| | | | |
|---|---|---|---|
| JP | 10-268595 | | 10/1998 |
| JP | 11-007205 | | 1/1999 |
| JP | 2004-109706 | | 4/2004 |
| JP | 2004-251961 | | 9/2004 |
| JP | 2006-085153 | | 3/2006 |
| JP | 2006-133816 | | 5/2006 |
| JP | 2006-347710 | | 12/2006 |
| JP | 2006-350248 | | 12/2006 |
| JP | 2007-264593 | | 10/2007 |
| JP | 2007-316427 | | 12/2007 |
| JP | 2007-334292 | | 12/2007 |
| JP | 2007322813 | A * | 12/2007 |
| JP | 2008-032807 | | 2/2008 |
| JP | 2008-040215 | | 2/2008 |
| JP | 2008-040289 | | 2/2008 |
| JP | 2008-058437 | | 3/2008 |
| JP | 2008-094573 | | 4/2008 |
| JP | 2008-096557 | | 4/2008 |
| JP | 2008-170908 | | 7/2008 |
| JP | 2006-259208 | | 9/2009 |

* cited by examiner

| | WHEN SHEET IS THICK OR STIFF | WHEN SHEET IS THIN OR NOT STIFF |
|---|---|---|
| ROTATION SPEED OF TRANSFER ROLLER |  |  |

INTERMEDIATE TRANSFER DEVICE, IMAGE FORMING APPARATUS AND SECONDARY TRANSFER METHOD

BACKGROUND OF THE INVENTION

1. Field of the Invention

The present invention relates to an intermediate transfer device, an image forming apparatus using the same and a secondary transfer method.

2. Discussion of the Background

Among color image forming apparatuses employing electrophotography, for example, tandem type image forming apparatuses widely employ a system in which an image formed on an intermediate transfer belt by primary transfer is secondarily transferred to a recording medium such as paper. When a transfer roller is used as a secondary transfer device that transfers a toner image formed on an intermediate transfer belt to a recording medium by such secondary transfer, the transfer speed of the intermediate transfer belt varies due to the shock at the time when the recording medium enters into the secondary transfer portion. This distorts images, which is referred to as shock jitter.

A technology that is known to prevent this shock jitter describes an image forming apparatus having a toner image bearing member that bears a toner image, a pressure transfer body arranged in the vicinity of the toner image bearing member, a transfer medium thickness detection device to detect the thickness of a transfer medium, and a gap adjustment device. The pressure transfer body presses the transfer medium entering between the toner image bearing member and the pressure transfer body to the toner image bearing member to transfer (and attach) a toner image thereon to the transfer medium. The gap adjustment device automatically changes the gap between the toner image bearing member and the pressure transfer body according to the detection information from the transfer medium thickness device.

In addition, another technology to adjust the gap describes an image forming apparatus having an image bearing member that rotates and bears an image, a transfer member, a recording medium transfer device, and a gap formation device. The transfer member rotates in contact with the image bearing member and transfers an image formed on the surface of the image bearing member to a recording medium. The recording medium transfers the recording medium to the contact position between the image bearing member and the transfer member. The gap formation device forms a gap at the contact position just before the recording medium enters into the contact position.

The technology described above first detects the thickness of a transfer medium and adjusts the gap between the secondary transfer portions to securely relax the shock occurring when the transfer medium enters between a toner image bearing member and a pressure transfer body or is released from therebetween regardless of the thickness of the transfer medium. However, the shock jitter is affected by stiffness and the from of the front end of a transfer medium which vary depending on the kind of the recording medium. Therefore, the shock jitters are not completely prevented by simply adjusting the gap based on the information on the thickness of the recording medium. In addition, the technology secondarily described above sets the timing for forming the gap, but is not sufficient to completely prevent the occurrence of shock jitters.

SUMMARY OF THE INVENTION

Because of these reasons, the present inventors recognize that a need exists for an intermediate transfer device that securely prevents the occurrence of shock jitters and an image forming apparatus using the intermediate transfer device.

Accordingly, an object of the present invention is to provide the intermediate transfer device that securely prevents the occurrence of shock jitters and an image forming apparatus using the intermediate transfer device.

Briefly this object and other objects of the present invention as hereinafter described will become more readily apparent and can be attained, either individually or in combination thereof, by an intermediate transfer device including an intermediate transfer body having a primary transfer portion and a secondary transfer portion which bears a secondary image formed by transferring a primary image from an image bearing member; a pair of secondary transfer rollers including a secondary transfer roller and a support roller provided in contact with each other at the secondary transfer portion via the intermediate transfer body; a variation detection device that detects an amount of variance occurring to a transfer rotation body when the recording medium is transferred to the secondary transfer portion; and an adjustment device that adjusts the distance between the pair of the secondary transfer rollers according to the amount of variance detected by the variation detection device. In addition, the pair of secondary transfer rollers transfers the secondary image to a recording medium at the secondary transfer portion.

It is preferred that, in the intermediate transfer device mentioned above, the distance is defined as the distance between the center of the secondary transfer roller and the center of the support roller.

It is still further preferred that, in the intermediate transfer device mentioned above, the amount of variance is a speed variation of the transfer rotation body.

It is still further preferred that, in the intermediate transfer device mentioned above, the amount of variance is a variation of a driving current of a motor that drives the transfer rotation body.

As another aspect of the present invention, an image forming apparatus is provided which includes an image bearing member that bears a primary image; a primary transfer device; an intermediate transfer body including the first transfer portion and the secondary transfer portion which bears a secondary transfer image formed by transferring the primary image from the image bearing member by the primary transfer device at the first transfer portion; a pair of the secondary transfer rollers including a secondary transfer roller and a support roller provided in contact with each other via the intermediate transfer body at the secondary transfer portion, which transfers the secondary image to a recording medium at the secondary transfer portion; at least one pair of transfer rotation bodies that transfers the recording medium to the secondary transfer portion; a variation detection device that detects an amount of variance occurring to one pair of the at least one pair of transfer rotation bodies when the recording medium is transferred to the secondary transfer portion; and an adjustment device that adjusts a distance between the pair of the secondary transfer rollers according to the amount of variance detected by the variation detection device.

It is preferred that, in the image forming apparatus mentioned above, the distance is defined as a distance between a center of the secondary transfer roller and a center of the support roller.

It is still further preferred that, in the image forming apparatus mentioned above, the one pair of the at least one pair of transfer rotation bodies is structured in the same manner as the pair of the secondary transfer rollers with regard to form, dimensions, and material.

It is still further preferred that, in the image forming apparatus mentioned above, the amount of variance is a speed variation of the one pair of the at least one pair of transfer rotation bodies.

It is still further preferred that, in the image forming apparatus mentioned above, the amount of variance is a variation of a driving current of a motor that drives the one pair of the at least one pair of transfer rotation bodies.

It is still further preferred that, in the image forming apparatus mentioned above, the variance is represented by a speed changed from a normal rotation speed of the one pair of the at least one pair of transfer rotation bodies.

It is still further preferred that, in the image forming apparatus mentioned above, the amount of variance is represented by an amplitude from a steady state.

It is still further preferred that, in the image forming apparatus mentioned above, the amount of variance is represented by a time from a start of variance to back to normal.

It is still further preferred that, in the image forming apparatus mentioned above, the amount of variance is represented by a maximum amplitude from a normal status.

It is still further preferred that, in the image forming apparatus mentioned above, the amount of variance is represented by a minimum amplitude from a normal status.

It is still further preferred that, in the image forming apparatus mentioned above, the adjustment device comprises a storage device in which the correction amount for use in adjustment of the distance is stored in at least one table.

It is still further preferred that, in the image forming apparatus mentioned above, the at least one table for the correction amount is prepared per preset linear speed of the one pair of the at least one pair of transfer rotation bodies and is switched according to the linear speed.

It is still further preferred that, in the image forming apparatus mentioned above, the adjustment device comprises a storage device in which the correction amount for use in adjustment of the distance is stored in at least one table.

It is still further preferred that, in the image forming apparatus mentioned above, the at least one table for the correction amount is prepared per preset linear speed of the one pair of the at least one pair of transfer rotation bodies and is switched according to the linear speed.

It is still further preferred that, in the image forming apparatus mentioned above, the secondary image is a monochrome image.

It is still further preferred that, in the image forming apparatus mentioned above, the secondary image is a multi-color image.

As another aspect of the present invention, a secondary transfer method is provided which includes: transferring a primary image to an intermediate transfer body by a primary transfer device to form a secondary image; transferring the secondary image to a recording medium at a secondary transfer portion of the intermediate transfer body by a pair of secondary transfer rollers having a secondary transfer roller and a support roller; transferring the recording medium to the secondary transfer portion by at least one pair of transfer rotation bodies; detecting an amount of variance occurring to the at least one pair of transfer rotation bodies when transferring the recording medium to the secondary transfer portion; and adjusting the distance between the center of the secondary transfer roller and the center of the support roller.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
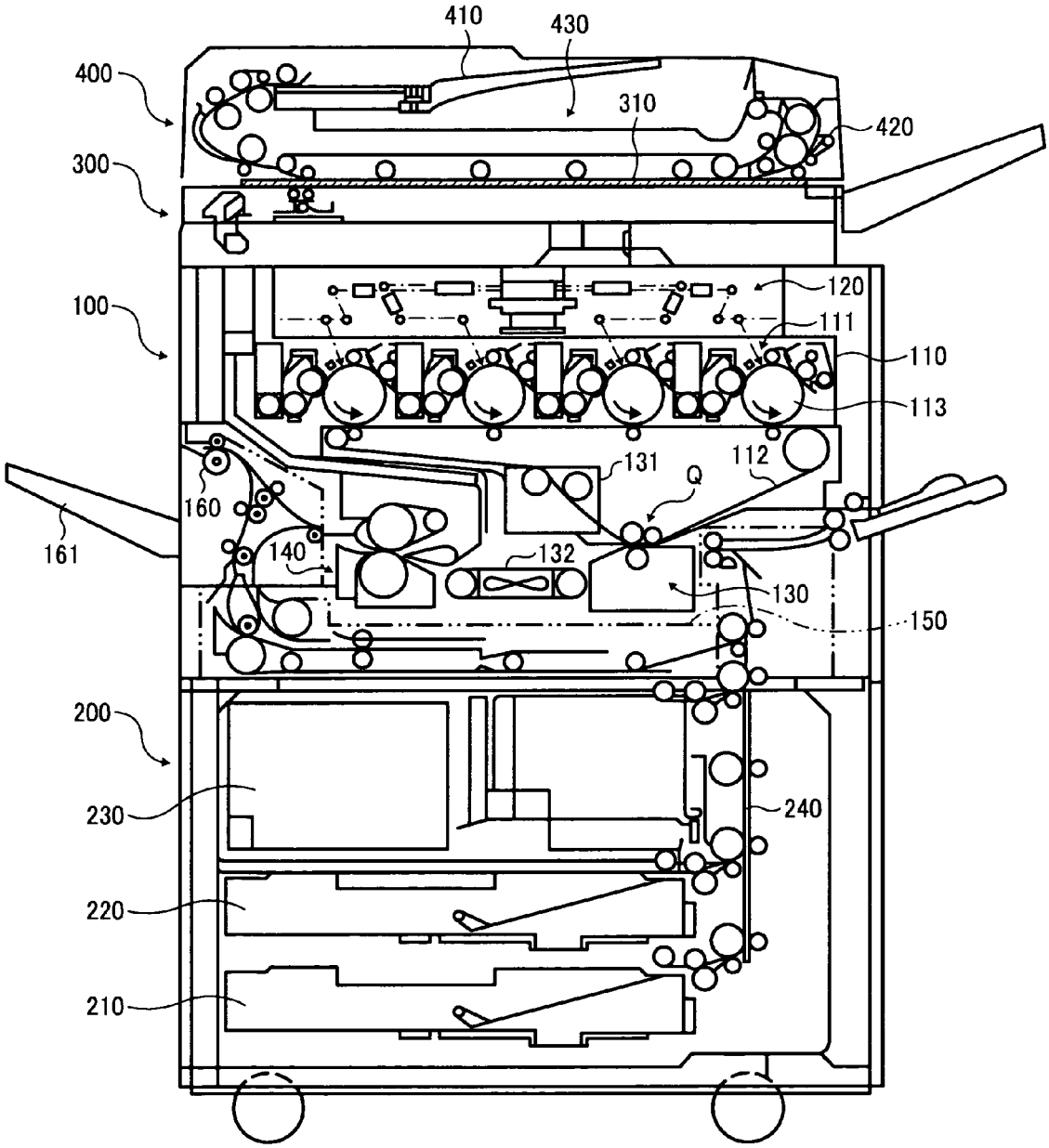
FIG. 1 is a schematic diagram illustrating an example of the structure of a tandem type image forming apparatus related to Embodiment 1, which is described later, of the present invention.

The present invention will be described below in detail with reference to several embodiments and accompanying drawings.

The intermediate transfer device of the present invention includes: an intermediate transfer body having a primary transfer portion and a secondary transfer portion which bears a secondary image formed by transferring a primary image from an image bearing member; a pair of secondary transfer rollers having a secondary transfer roller and a support roller provided in contact with each other via the intermediate transfer body at the secondary transfer portion; a variation detection device that detects an amount of variance occurring to a transfer rotation body when the recording medium is transferred to the secondary transfer portion; and an adjustment device that adjusts the distance between the pair of the secondary transfer rollers according to the amount of variance detected by the variation detection device. In addition, the pair of secondary transfer rollers transfers the secondary image to a recording medium at the secondary transfer portion.

In the following embodiments, the intermediate transfer belt 112 corresponds to the intermediate transfer body; the transfer unit 130 is the secondary transfer portion; the paper (sheet) represents the recording medium; the pair of the transfer rollers 133 represents the pair of the transfer rotation bodies; the transfer rollers 133*a* and 133*b* represent the transfer rotation bodies; the variation detection devices 130-A and 130-A1; the correction instruction value setting unit 130-B and the gap adjustment mechanism 136 represent the adjustment device; the gap G represents to the distance between the center of the secondary transfer roller and the center of the support roller; the reference numeral 130 represents the secondary transfer portion; the secondary transfer rollers 130R represents the secondary transfer roller; and the secondary transfer roller 119-2 represents the support roller.

Embodiment 1

Figure 2:
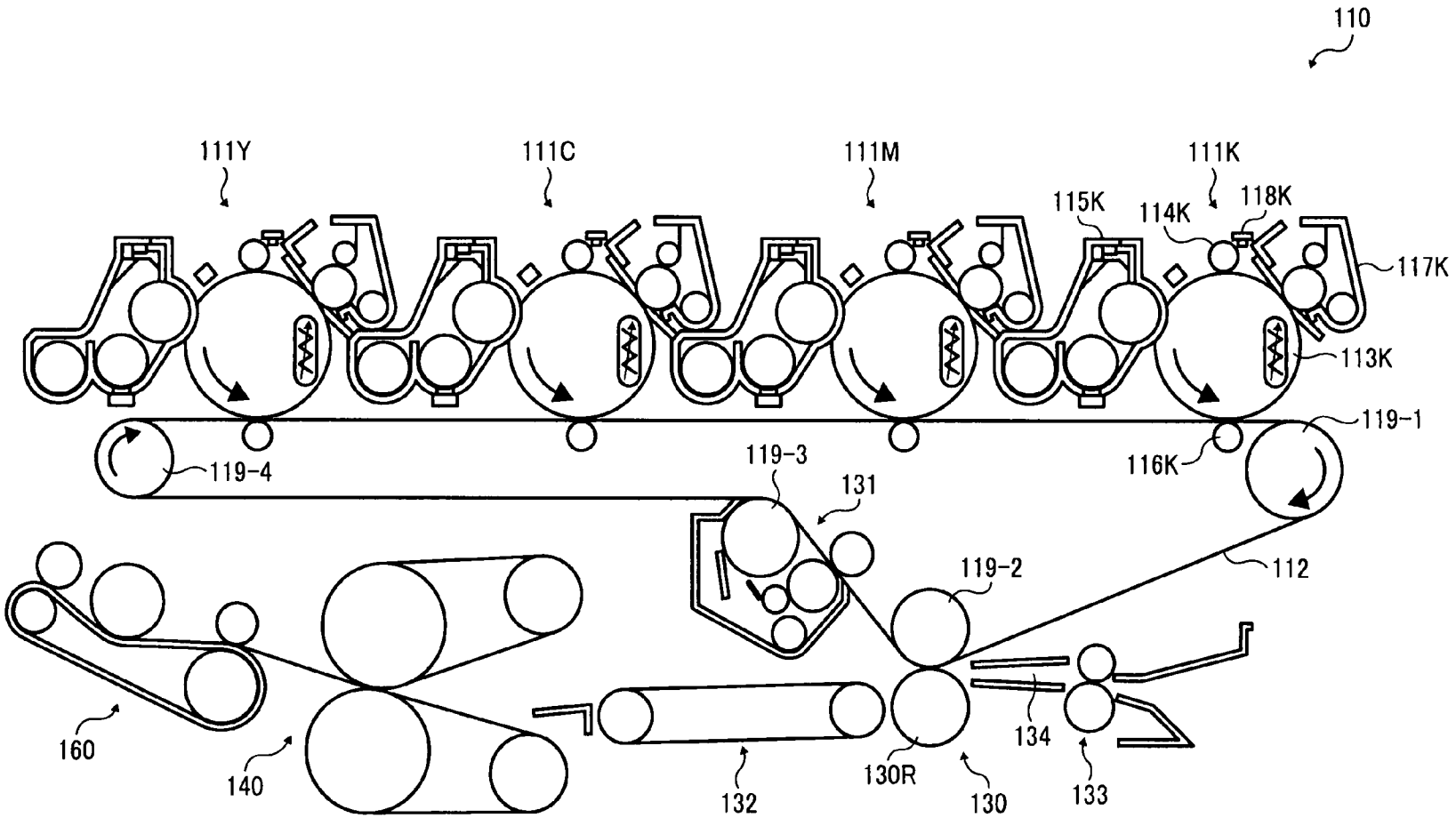
FIG. 2 is an enlarged diagram illustrating the main part of the image formation unit in FIG. 1.

FIG. 1 is a schematic diagram illustrating an example of the entire of a tandem type image forming apparatus relating to Embodiment 1 using the intermediate transfer device of the present invention. FIG. 2 is an enlarged diagram illustrating the main part of the image formation unit of the image forming apparatus.

In FIG. 1, the basic of the image forming apparatus is structured by a main body 100, a paper feeder 200 arranged below the main body 100, an image reader 300 situated above the main body 100 and an automatic document handler 400 located on the image reader 300.

The main body 100 includes an image formation unit 110, an optical writing unit 120, a transfer unit (secondary transfer portion) 130, a fixing unit 140, a duplex transfer unit 150 and a paper discharging unit 160.

The image formation unit 110 includes an image formation stations 111Y, 111C, 11M, and 111K and the optical writing unit 120 irradiates photoreceptor drums (image bearing member drum) 113 provided for respective colors of yellow, cyan, magenta, and black. The image formation stations 111Y, 111C, 111M and 111K are formed of the photoreceptor drum 113 and multiple image formation elements. The image formation elements are a known electrophotography unit including a charging unit 114, a development unit 115, a primary transfer device 116, a cleaning unit 117, and a discharging unit 118. The image formation elements develop a latent image formed on the surface of the photoreceptor drum 113 by optical writing with toner, transfer the developed image to an intermediate transfer belt 112 at the primary transfer device 116 sequentially to overlap the color images thereon, and transfer the overlapped toner image to a recording medium (paper) fed from a transfer path at the transfer unit 130. The paper on which the toner image is transferred is heated and pressed at a fixing unit 140 to fix the toner image and discharged from the paper discharging unit 160 to a paper discharging tray 161. A reference numeral 131 represents a cleaner for the intermediate transfer belt 112. In FIG. 2, the image formation elements are labeled only for black (K) to avoid complexity and thus reference numerals are omitted for other image formation elements (Y, M and C).

The paper is transferred from the paper discharging unit 160 to the duplex transfer unit 150 in duplex mode and another image is formed on the bottom side of the paper followed by fixing and discharging.

The paper feeder 200 includes multiple paper trays 210, 220 and 230. Paper is fed from one of the paper trays 210, 220 and 230 to the transfer unit 130 via a vertical transfer path 240 and multiple pairs of transfer rollers (transfer rotation body) 133.

The image reader 300 is a known device which reads a document on a contact glass 310 with a sheet through system or a flat head system. The image reader 300 includes a first carriage on which a light source and a first mirror are provided, a second carriage having second and third mirrors which moves at a half speed in the sub-scanning direction of the moving speed of the first carriage in the sub-scanning direction, a focus lens that focuses reflection light of the document reflected at the first to the third mirror on the focus phase of a photoelectric conversion element such as a charge coupled device (CCD), and an optical reading system that reads the document image focused on the focus phase and includes a CCD that performs photoelectric conversion. In the optical reading system employing the sheet through system, the first and the second carriages stop at predetermined positions. Then, the optical reading system reads a document transferred by the automatic document handler 400 at a predetermined position of the contact glass 310. In the optical reading system employing the flat head system, the first and the second carriages move to read the document placed on the contact glass 310.

The automatic document handler 400 takes out paper placed on a document platform 410 from top thereof one by one and transfers the sheet through reading position or reverses a document one side of which has already been read at a document reverse unit 420 and sends the document back to the contact glass 310 again to read one side or both sides of the document by the image reader 300 followed by discharging the document to a document discharging platform 430.

The main body 100 includes the intermediate transfer belt 112 formed of a belt (intermediate transfer body) functioning as the image bearing member in the center of the main body 100. The intermediate transfer belt 112 are suspended over first to fourth support rollers 119-1, 119-2, 119-3 and 119-4 functioning as support rotation bodies as illustrated in FIG. 2. The intermediate transfer belt 112 rotationarily moves clockwise in FIG. 2. An intermediate transfer belt cleaner 131 that removes residual toner remaining on the intermediate transfer belt 112 after image transfer is provided to the third support roller 119-3 among these four support rollers 119-1, 119-2, 119-2 and 119-4.

The four image formation stations 111Y, 111C, 111M and 111K are arranged on the belt portion suspended between the fourth support roller 119-4 and the first support roller 119-1 among the four support rollers along the belt transfer direction. In Example 1, the first support roller 119-1 is a driving roller and the other rollers are driven rollers.

The transfer unit 130 functioning as the second transfer device as described above is provided at the position facing the second support roller 119-2 with the intermediate transfer belt 112 between the transfer unit 130 and the second support roller 119-2. The transfer unit 130 has a secondary transfer roller 130R and transfers an image on the intermediate transfer belt 112 to a transfer medium by controlling charging of the surface of the secondary transfer roller 130R. A sheet transfer device 132 that transfers the transfer medium to the fixing unit 140 after image transfer at the secondary transfer roller 130 R is provided on the downstream side thereof relating to the paper transfer direction to the fixing unit 140.

A document is photocopied by the image forming apparatus (photocopier) described above as follows: Set a document on the document platform 410 of the automatic document handler 400 or on the contact glass of the image reader 300 after opening the automatic document handler 400 followed by shutting down and pressing down the automatic document handler 400; Press the start button (not shown) to drive the image reader 300 to move the first carriage on which the light source and the first mirror are provided and the second carriage on which the second mirror and the third mirror are provided in the sub-scanning direction when the document is set on the contact glass or press the start button (not shown) to transfer the document to the contact glass 310 when the document is set on the automatic document handler 400 before driving the image reader 300 described above; thereafter, the light source in the first carriage irradiates the document with light; Reflection light from the document is reflected at the first mirror and guided to the second carriage; and the light entering into the second carriage is reflected at the second mirror and the third mirror and focused on the focus phase of the reading sensor via the focus lens to read the document.

In parallel to this document reading operation, a driving motor (not shown) functioning as a driving source is driven to drive and rotate the first support roller 119-1, thereby moving the intermediate transfer belt 112 clockwise in FIG. 2 and rotating the three remaining support rollers (driven rollers) 119-2, 119-3 and 119-4. At the same time, the photoreceptor drums 113Y, 113C, 113M and 113K in the image formation stations 111 are rotated and yellow, magenta, cyan and black toner images are formed on the photoreceptor drums 113Y, 113C, 113M and 113K respectively according to respective color information on yellow, magenta, cyan and black by irradiation and development.

The yellow, magenta, cyan and black toner images on the photoreceptor drums 113Y, 113C, 113M and 113K are sequentially transferred to and overlapped on the intermediate transfer belt 112 to obtain a synthesized color image on the intermediate transfer belt 112. At the same time, paper fed from one of the paper trays 210, 220 and 230 in the paper feeder 200 is guided to a transfer path 134 in the main body 100. Thereafter, the paper is sent between the intermediate transfer belt 112 and the secondary transfer roller 130R via the pair of the transfer rollers 133 and a registration roller (not shown). The image on the intermediate transfer belt 112 is secondarily transferred to the paper by the secondary transfer roller 130R. The paper after the secondary transfer is fixed and discharged as described above.

In addition, only the photoreceptor drum 113K in the image formation station 111*k* which forms a black image is brought into contact with the intermediate transfer belt 112 to obtain a monochrome image while keeping the other three color image formation stations 111Y, 111C and 111M to be separated from the intermediate transfer belt 112. Therefore, monochrome images are efficiently and cleanly formed. The operation to bring the image formation station 111 into contact with the intermediate transfer belt 112 and separate them from each other is conducted by the intermediate transfer roller 116 which applies or releases a pressure of the intermediate transfer belt 112 to the photoreceptor drum 117.

Figure 3:
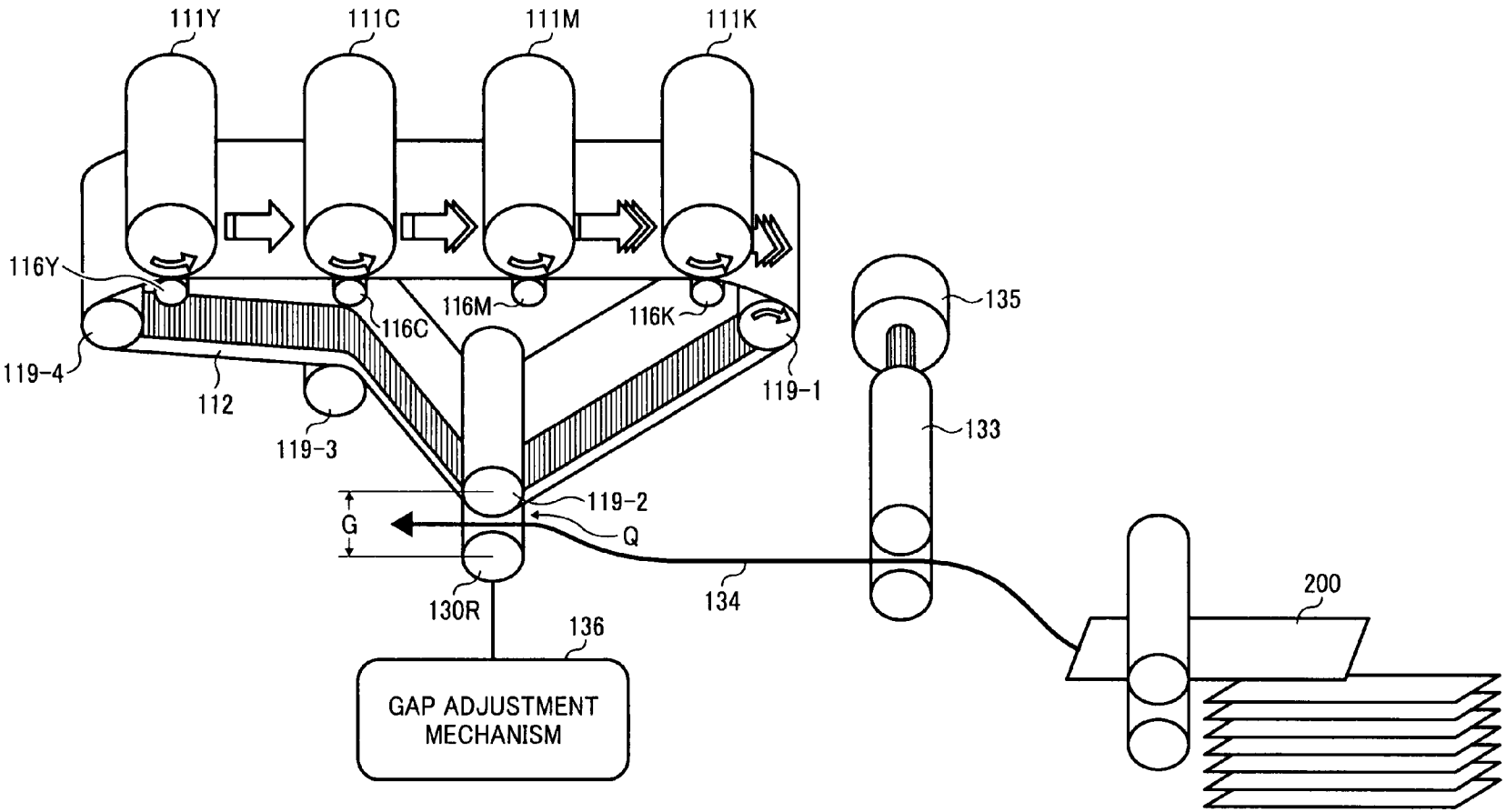
FIG. 3 is a diagram illustrating the summary relationship among the secondary transfer portion, the transfer roller device and the paper feeder in Embodiment 1.

FIG. 3 is a diagram illustrating the schematic positional relationship among the secondary transfer portion 130, the transfer rollers 133, and the paper feeder 200. As illustrated in FIG. 3, an encoder 135 is provided on the side of a driven roller of one pair of the transfer rollers 133 among at least one pair of the transfer rollers 133 on part of the transfer path 134 which is between the paper feeder 200 and a nip (contact) portion Q formed by the intermediate transfer belt 112 and the secondary transfer roller 130R in the secondary transfer portion 130 in Embodiment 1. In addition, a gap adjustment mechanism 136 is provided to adjust the distance (hereinafter referred to as gap G) between the center of the secondary transfer roller 130R and the center of the support roller 119-2. The gap adjustment mechanism 136 adjusts the gap G based on the speed variance of the transfer roller detected by the encoder 135.

Figure 4:
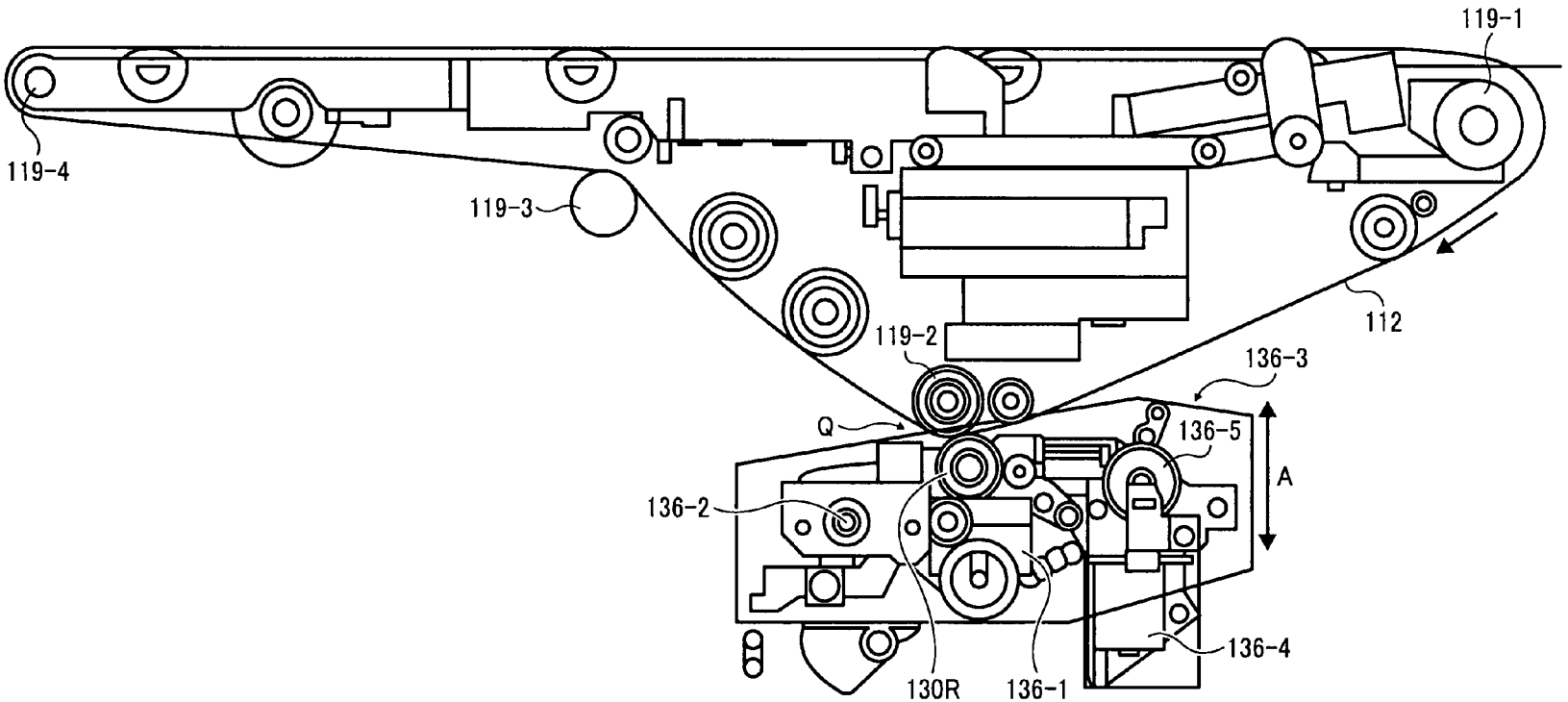
FIG. 4 is an enlarged diagram illustrating the main part of the gap adjustment mechanism in Embodiment 1.

FIG. 4 is an enlarged diagram of the gap adjustment mechanism 136. The gap adjustment mechanism 136 shakes a base 136-1 in the direction indicated by an arrow A that supports the secondary transfer roller 130R relative to the fulcrum point 136-2 to adjust the gap G between the center of the secondary transfer roller 130R and the center of the second support roller 119-2. A driving mechanism 136-3 linked to the base 136-1 on the remote side of the fulcrum point 136-2 performs this adjustment. The driving mechanism 136-3 includes a stepping motor 136-4 and a gear speed reduction mechanism 136-5 and stores the number of driving steps of the stepping motor 136-4 and the moving amount of the base 136-1 driven via the gear speed reduction mechanism 136-5 in a table beforehand. According to the required amount of gap adjustment, the driving mechanism 136-3 controls the number of driving steps for the stepping motor 136-4, thereby adjusting the gap G to be desirable.

The gap G is adjusted due to the speed variance caused when a recording medium (paper) enters into the nip (contact portion) Q formed between the intermediate transfer belt 112 and the secondary transfer roller 130R of the secondary transfer portion 130. The speed variance is different depending on the kind, thickness, etc. of the paper. Similar speed variance ascribable to entering of paper occurs at the pair of the transfer rollers 133 provided in the transfer path 134 which guides the paper from the paper feeder 200 to the secondary transfer portion 130 before the speed variance at the secondary transfer portion 130. The speed variance at the pair of the transfer rollers 133 is slightly different from that at the secondary transfer portion 130 because the speed variance depends on material of the transfer rollers, friction coefficient, moment of inertia, etc. but both speed variances have a relationship.

Therefore, the speed variance at the pair of the transfer rollers 133 in the transfer path 134 between the paper feeder 200 and the secondary transfer portion 130 is measured as paper enters into the transfer rollers 130 as described above and the measuring result is used to adjust the gap G at the secondary transfer portion 130. The material and the structure of the pair of the transfer rollers 133 to which the encoder 135 is provided are preferably set to be significantly the same as those of the rollers at the secondary transfer portion (i.e., the secondary transfer roller 130R and the second support roller 119-2) to have the same conditions. The transfer roller 133 and the encoder 135 form a variation detection device 130-A (Refer to FIG. 5).

Figure 5:
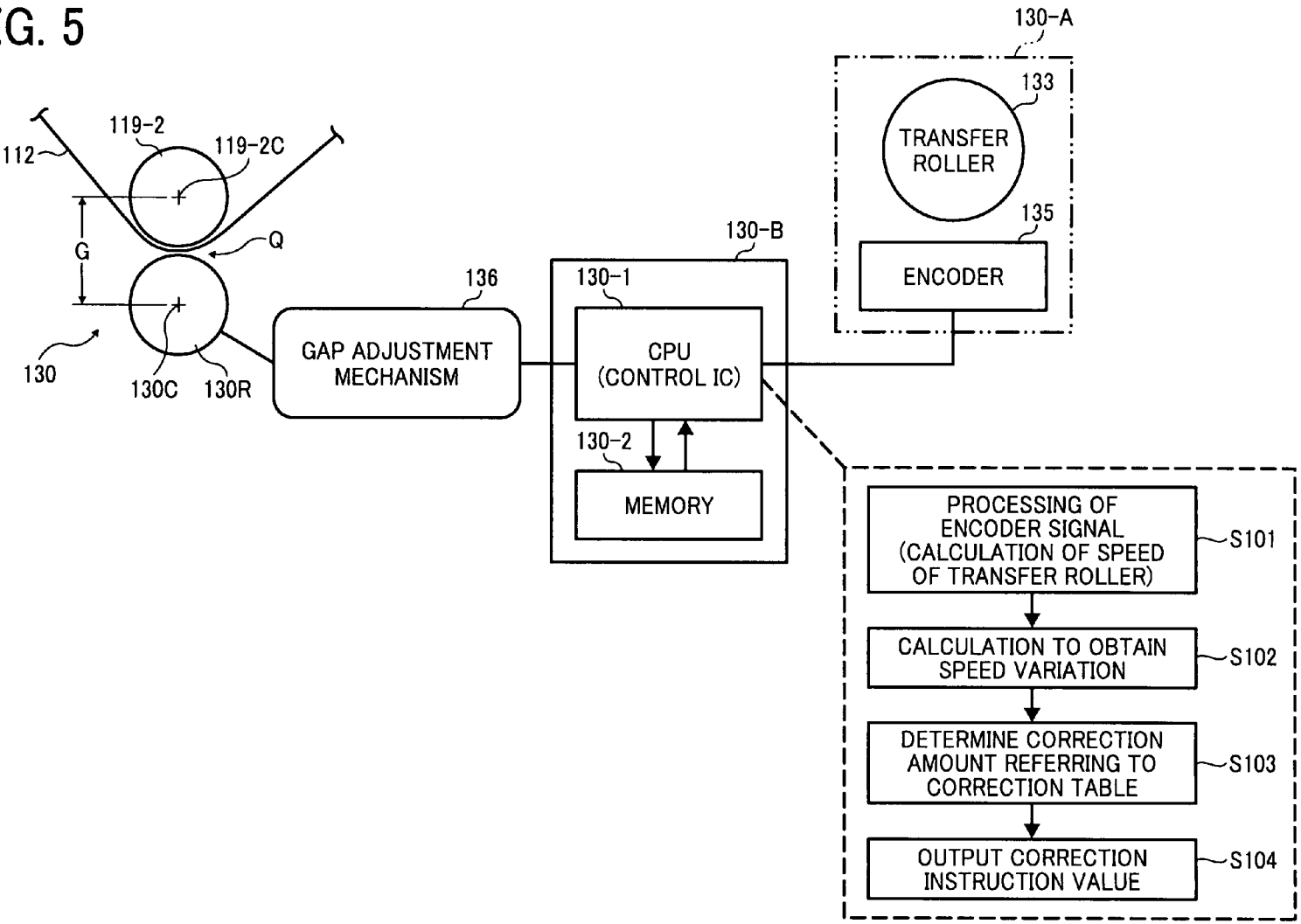
FIG. 5 is a block chart illustrating an example of the control structure that performs the gap adjustment control of the secondary transfer portion in Embodiment 1.

FIG. 5 is a block chart illustrating an example of the control structure to control the adjustment of the gap G at the secondary transfer portion in Embodiment 1. In FIG. 5, the control structure to adjust the distance (gap G) between the center 130C of the secondary roller 130R and the center of 119-2C of the second support roller 119-2 includes a correction instruction value setting unit 130-B formed of a control IC (ASIC) 130-1 and a memory 130-2 that stores data required to control the control IC 130-1. The output of the encoder 135 is input to the control IC (ASIC) 130-1 to drive and control the stepping motor 136-4 of the gap adjustment mechanism 136. A central processing unit (CPU) can be used instead of the control IC.

The encoder 135 outputs signals according to the speed of the pair of the transfer rollers 133. The control IC 130-1 performs the speed calculation processing (Step S101) of the pair of the transfer rollers 133 based on the encoder signal and obtains (extracts) the speed variation (maximum amplitude, minimum amplitude, and the difference between the two) (step S102). Thereafter, the control IC 130-1 performs the next step (Step S103) of calculating the amount of correction of the gap G of the secondary transfer portion 130 based on the speed variation, and outputs the number of driving steps (Step 104) corresponding to the correction instruction value to the stepping motor 136-4. The gap adjustment mechanism 136 drives the stepping motor 136-4 in an amount of the steps corresponding to the correction instruction value by shaking the secondary transfer roller 130R relative to the fulcrum point 136-1 to adjust the gap G.

The control IC 130-1 extracts (obtains) the speed variation from the rotation information input from the encoder 135 and therefore also functions as an element of the variation detection device 130-A. The speed variation is obtained by the detected speed or the speed change from the normal speed.

Figure 6:
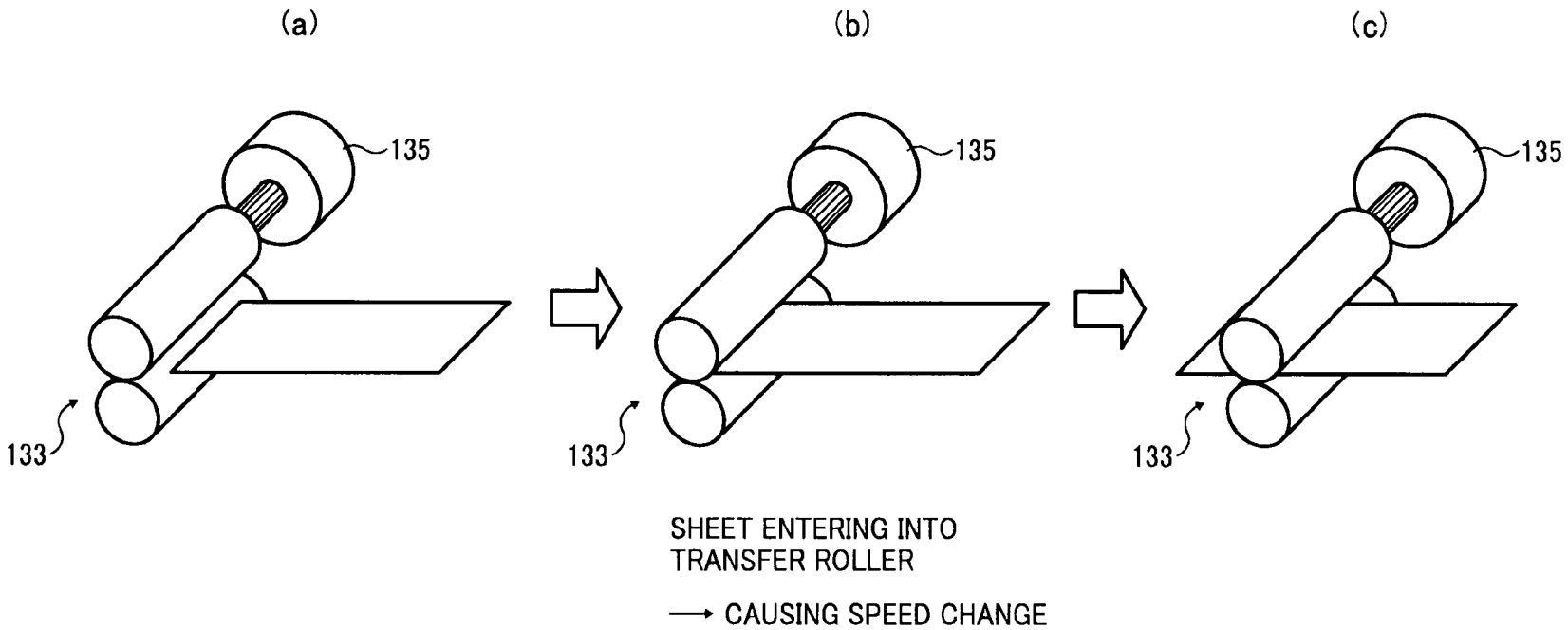
FIG. 6 is a diagram illustrating the status in which paper enters into the nip (contact portion) of the pair of transfer rollers in Embodiment 1.
Figure 7:
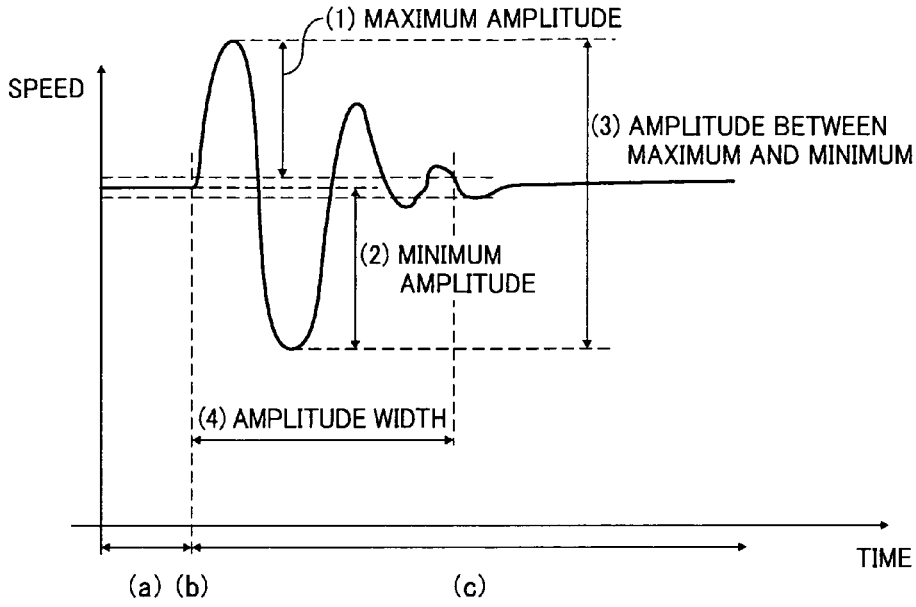
FIG. 7 is a diagram illustrating the status of speed variance of the pair of the transfer rollers when paper enters into the pair of the transfer rollers in Embodiment 1.

FIG. 6 is a diagram illustrating a state when paper enters into the nip portion formed between the pair of the transfer rollers 133. FIG. 7 is a diagram illustrating the speed variance of the pair of the transfer rollers 133 when paper enters into the nip portion formed between the pair of the transfer rollers 133. In FIG. 6, the (a) represents the state just before paper enters into the pair of the transfer rollers 133, (b) represents the state when paper enters into the pair of the transfer rollers 133, and (C) represents the state in which the paper is transferred while pinched at the nip portion. The state (a) of FIG. 6 corresponds to the time (a) on the X axis. That is, the paper is transferred at a predetermined constant speed before the paper enters into the nip portion formed by the pair of the transfer rollers 133. Then, as illustrated in the state (b) of FIG. 6, the paper is brought into contact with the nip portion of the pair of the transfer rollers 133 and the speed changes when the paper is pinched, causing speed variance. The speed increases to the maximum. Next, when the speed reaches the maximum, the speed turns to decrease to the minimum. Thereafter, the speed converges to the above-mentioned constant speed while the speed fluctuates upward and downward around the constant speed.

The speed variations obtained from the speed variance are:
(1) the maximum amplitude
(2) the minimum amplitude and
(3) the difference between (1) and (2), of the speed variance.

In addition, (4) the width (time) of fluctuation (amplitude) is also used to calculate the correction amount. In FIG. 7, the width of fluctuation represents a time between when a signal surpasses a preset threshold and the last time the signal converges from the outside of the preset threshold within the preset threshold in a preset period of time. The preset threshold is, for example, + or −3% from an ideal speed. The preset period of time is an anticipated time during which the speed changes at the entering of paper. At least this anticipated time is shorter than the time to be taken for a sheet of paper to pass through the nip portion and determined based on experiments.

Figure 8:
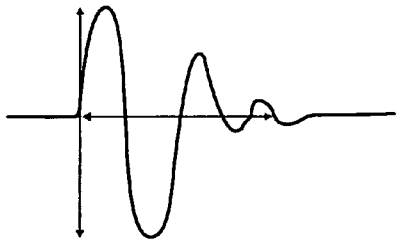
FIG. 8 is a diagram illustrating an example of the detection speed of pair of the transfer rollers depending on the difference with regard to the thickness and the kind of paper.
Figure 8:
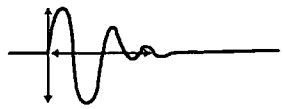
Figure 9A:
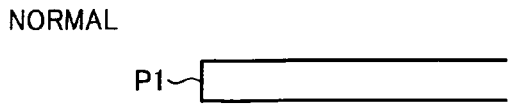
FIG. 9 is a diagram illustrating examples of the form of the front end of paper.
Figure 9B:
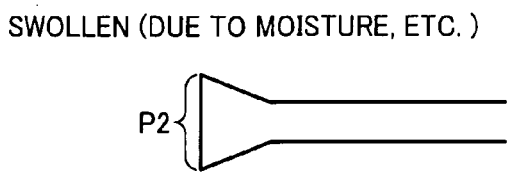
Figure 9C:
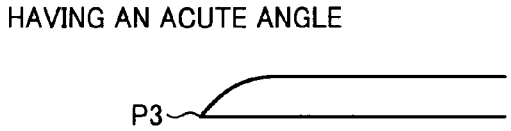

FIG. 8 is a diagram illustrating an example of the detected speed of the pair of the transfer rollers 133 by the thickness and the kind of paper. The speed variance of the pair of the transfer rollers 133 varies depending on the thickness and the kind of paper (stiffness in this example but the difference with regard to the form of the front end of paper also included). The thicker and the stiffer the paper, the larger the speed variance. In addition, with regard to the form of the front end of paper, paper having a swollen front end P2 {refer to (b) in FIG. 9} due to moisture, etc. has a larger speed variance in comparison with paper having a normal front end P1 {refer to (a) in FIG. 9}. To the contrary, paper having a sharp (acute) angled front end P3 {refer to (c) in FIG. 9} has a less speed variance when compared with paper having a normal end P1. According to this, simply dealing with paper thickness is obviously insufficient to deal with speed variance.

Table 1 is an example of correction tables to obtain the amount of correction to adjust the gap G based on the speed variance. At least one speed variation of (1) to (3) described above is referred to obtain the amount of correction of the gap G. When the speed 23. variation is within a predetermined range, a constant value is output. The amplitude (coefficient) in the correction table is calculated by the following relationship:

The maximum amplitude and the minimum amplitude of (1) and (2) are calculated by the following relationship (1):

$$\text{Maximum(Minimum)amplitude(\%)} = |(\text{Maximum (Minimum)speed} - \text{Constant speed})/\text{Constant speed}| \times 100 \qquad \text{Relationship (1)}$$

(3) of (Maximum amplitude−Minimum amplitude) is calculated by the following relationship (2):

$$(\text{Maximum amplitude} - \text{Minimum amplitude})\ (\%) = |\text{Maximum speed} - \text{Minimum speed})/\text{Constant speed}| \times 100 \qquad \text{Relationship (2)}$$

The gap correction amount is set based on the amplitude calculated by the relationships (1) and (2) and the width (time) of fluctuation as described as (4). In Table 1, the correction amount to adjust the gap G corresponding to the speed variance is obtained by an experiment machine by machine from the above-mentioned maximum amplitude, minimum amplitude, (maximum−minimum) amplitude and width of fluctuation (second) and stored in the memory 130-2 as a correction table.

TABLE 1

| Maximum amplitude (%) | Minimum amplitude (%) | (Maximum amplitude) − (Minimum amplitude) (%) | Width of fluctuation (s) | Amount of gap correction |
|---|---|---|---|---|
| 0-0.1 | — | 0-0.2 | 0-0.2 | a |
| 0.1-0.2 | 0-0.1 | 0.2-0.4 | 0.2-0.4 | b |
| 0.2-0.3 | 0.1-0.2 | 0.4-0.6 | 0.4-0.6 | c |
| 0.3-0.4 | 0.2-0.3 | 0.6-0.8 | 0.6-0.8 | d |
| . . . | . . . | . . . | . . . | . . . |

When this correction table is referred and only one of the variations is referred, for example, when the maximum amplitude is 0.25%, the amount of correction is c according to the correction table. When the minimum amplitude is 0.25%, the amount of correction is d. When (the maximum amplitude−the minimum amplitude) is 0.25%, the amount of correction is b.

When multiple variations are referred to, for example, when the maximum amplitude is 0.25% and the width of fluctuation is 0.1 s, the amount of correction based on the maximum amplitude is c and the amount of correction based on the width of fluctuation is a. Thus, the amount of correction is set to be (c+a)/2. When this relationship is not employed, for example, the amount of correction is determined according to the priority assigned to the variations. The amount of correction is added to or subtracted from the initial value of the gap G. The gap G is about from 20 to about 25 mm in a tandem type image forming apparatus employing an indirect transfer system dealing with A4 to A3 paper.

Figure 10:
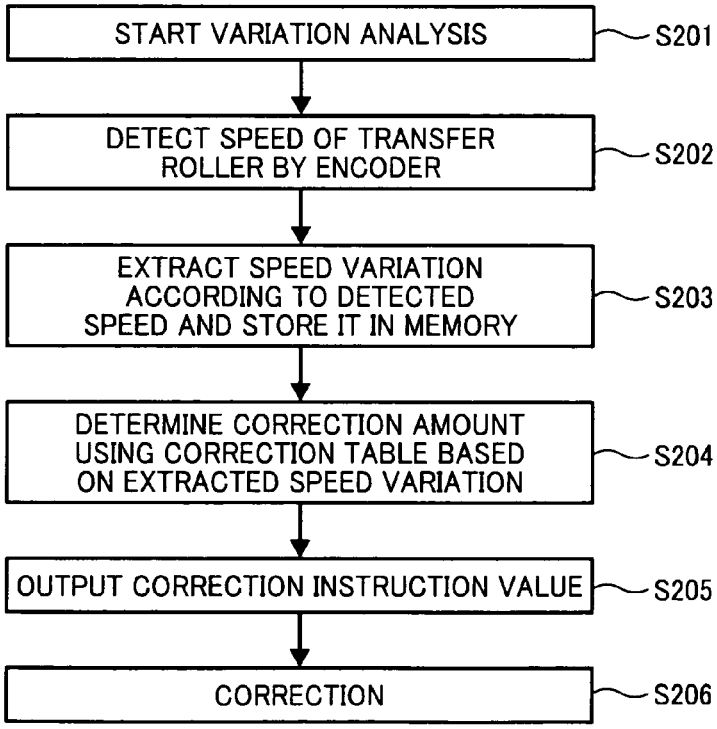
FIG. 10 is a flow chart illustrating an example of the processing procedure of the gap adjustment at the secondary transfer portion in Embodiment 1.

FIG. 10 is a flow chart illustrating the processing procedure of the gap adjustment at the secondary transfer portion. In FIG. 10, after paper feeding starts and paper is determined to have passed through when the variation from the normal state surpasses a predetermined value, the analysis starts (step S201) and the rotation speed of the pair of the transfer rollers 133 is detected (S202). The speed variation (the maximum amplitude, the minimum amplitude, maximum amplitude−minimum amplitude) and width of fluctuation are extracted from the speed variance occurring when paper reaches the pair of the transfer rollers 133 and enters into the nip portion of the pair of the transfer rollers 133, and stored in the memory 130-2 (Step S203).

The correction amount corresponding to the extracted speed variation or the width of fluctuation is obtained with reference to the correction table (Table 1) (Step S204). Then, the correction instruction value is output (Step S205) according to the obtained correction amount to correct the gap G (Step S206). The corrected gap G is held until the paper passes through the secondary transfer portion.

This correction procedure is preliminarily stored in the control IC 130-1, which repeats this control every time paper passes through the nip portion of the pair of the transfer rollers 133.

Figure 11:
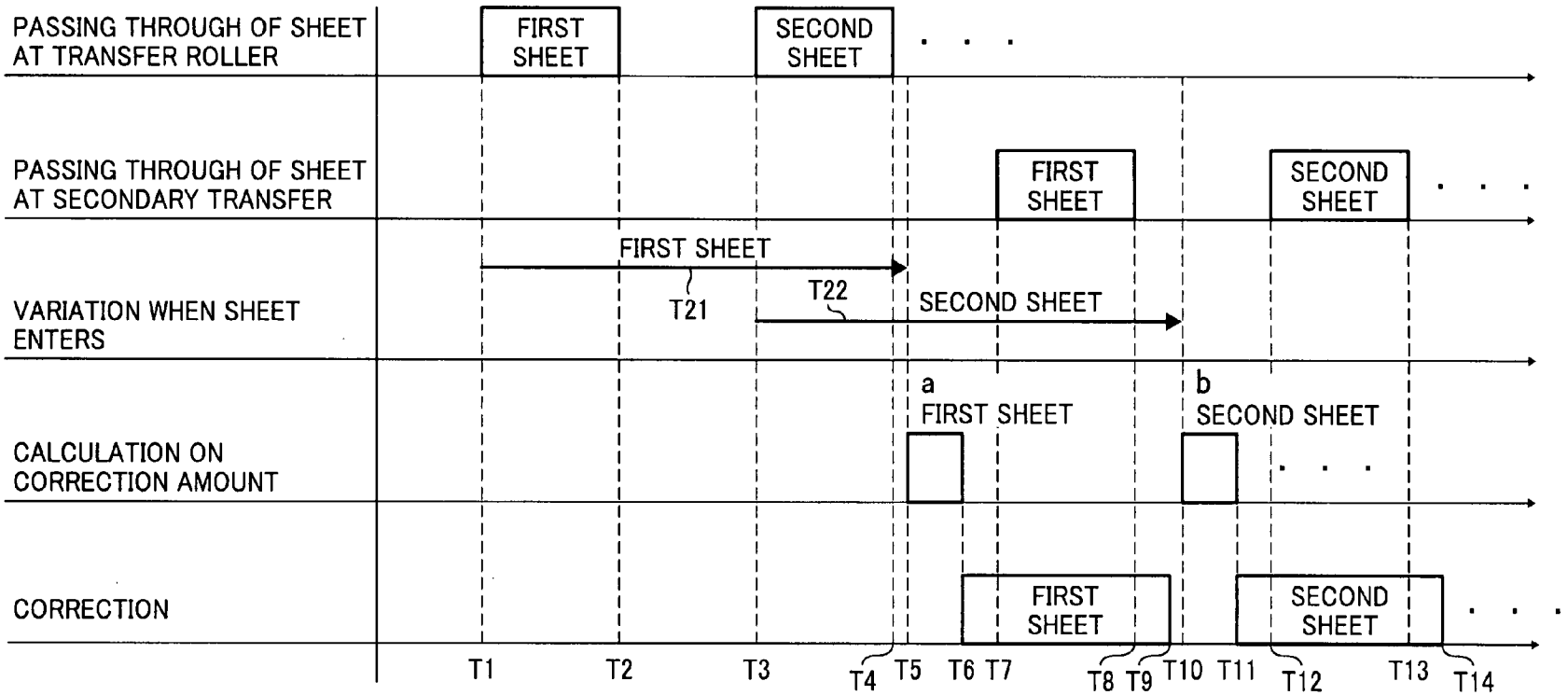
FIG. 11 is a timing chart illustrating an example of the control timing when the paper transfer path between the transfer rollers and the secondary transfer portion in Embodiment 1.

FIG. 11 is a timing chart illustrating the control timing of the case illustrated in FIG. 10 when the transfer path between the transfer rollers and the secondary transfer portion is long. That is, when the transfer path between the pair of the transfer rollers 133 and the secondary transfer portion 130 is long, the first paper (sheet) enters into the pair of the transfer rollers 133 at T1. It takes a time after the first paper completely passes through the nip portion at T2 and before the first paper reaches the secondary transfer portion at T7. Meanwhile, the second paper (sheet) enters into the pair of the transfer rollers 133 somewhere during this period of time and passes therethrough (T3 to T4). If the amount of correction is determined immediately after paper (sheet) passes through the pair of the transfer rollers 133 in this case, the correction that should be done for the second paper at the secondary transfer portion 130 may be performed to the first paper (sheet). Therefore, the variations when paper enters into the nip portion are stored for a predetermined period of time (T21) and the amount of correction is calculated during T5 to T6, which is immediately before the first paper enters into the secondary transfer portion 130. Thereafter, the correction is made during T6 to T9. Similarly, when the second paper enters into the pair of the transfer rollers 133, the variations are stored for a predetermined period of time (T22). When the pass-through of the first paper and the correction are complete (T8 to T9), the amount of correction of the second paper is calculated. After the correction starts (T10), the second paper enters into the secondary transfer portion 130 (T11). After the second paper passes through the secondary transfer portion 130 (T13) and the correction is complete (T14), the correction procedure starts for the third paper (sheet).

Figure 12:
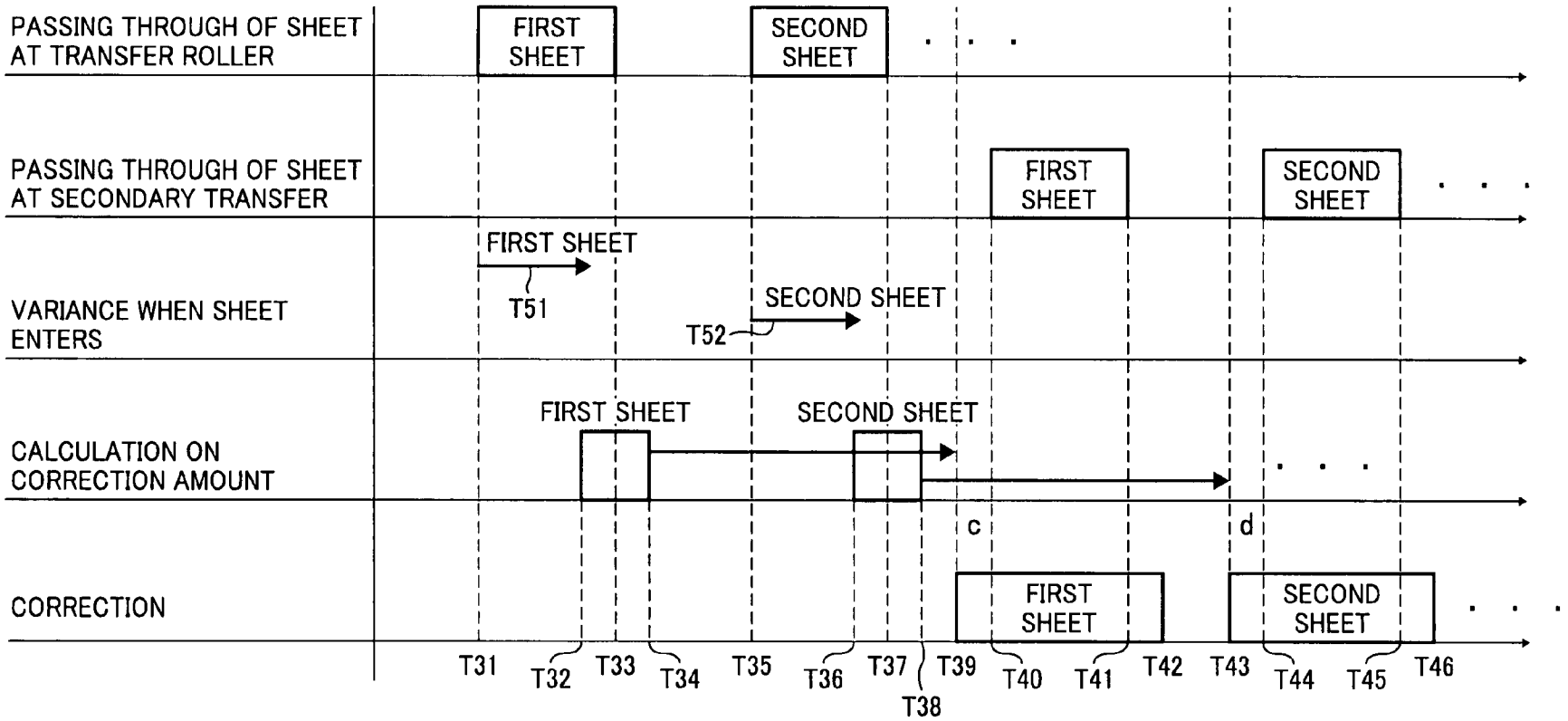
FIG. 12 is a timing chart illustrating an example of the control timing when the calculation of the correction amount is performed earlier than the case of FIG. 12.

FIG. 12 is a timing chart illustrating an example in which the correction is calculated earlier than in the example illustrated in FIG. 11. In this example illustrated in FIG. 12, the variations are stored (T51 or T52) immediately after the first or second paper (sheet) enters into the pair of the transfer rollers 133 (T31 or T35). The amount of correction is calculated (T33 or T36) and the gap G is corrected immediately before the first or second paper enters into the secondary transfer portion 130 (T39 or T43). This amount of correction is maintained (T39 to T42 or T43 to T46) for the period of time of passing-through of the paper. This procedure is repetitively performed.

Since the gap G is corrected according to the processing procedures described above in such timings, the speed variance occurring when paper enters into the secondary transfer portion 130 can be minimized. As a result, quality images are obtained.

Figure 13A:
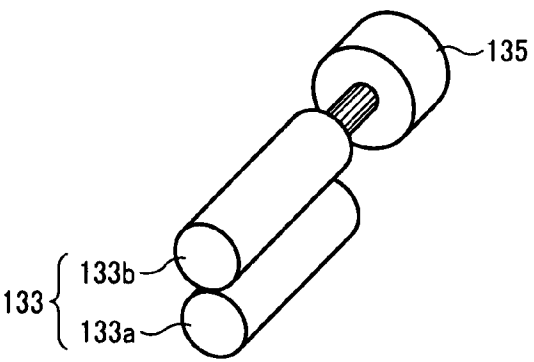
FIG. 13 is a diagram illustrating multiple examples of arrangement of the encoder to the pair of transfer rollers.
Figure 13B:
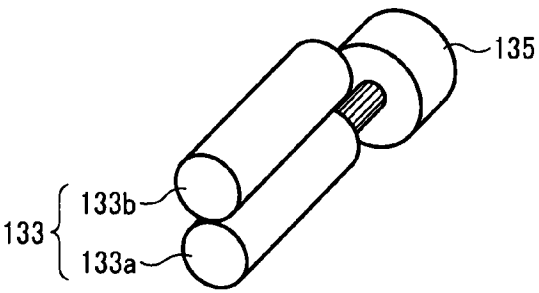
Figure 13C:
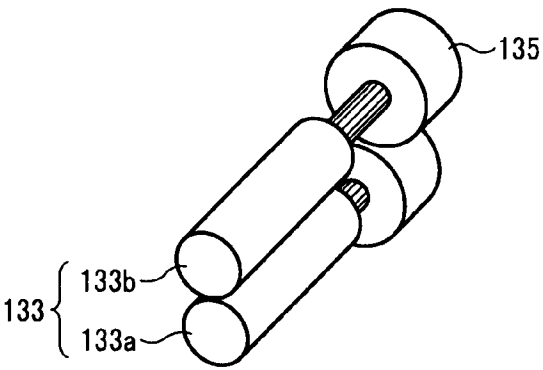

In the examples illustrated in FIGS. 3 and 6, the encoder 135 is attached to the same axis of a driven top transfer roller 133*b* of the pair of the transfer rollers 133 as illustrated in FIG. 13A. The encoder 135 can be attached to a driving transfer roller 133*a* (refer to FIG. 13B) or both driven top transfer roller 133*b* and driving top transfer roller 133*a* (refer to FIG. 13C). In any cases, only the encoder signals in the processing (Step S101) of the encoder signal performed at the Control IC 130-1 are changed.

In addition, when the transfer speed is changed according to the product specification, the correction table is changed from Table 1 to Table 2 in which additional amounts of correction $\alpha$1, $\alpha$2, $\alpha$3, and $\alpha$4 are added to the gap correction amounts a, b, c, and d. The additional amounts of correction $\alpha$1, $\alpha$2, $\alpha$3, and $\alpha$4 are determined according to experiments depending on the amount of change in the transfer speed. Since the additional amounts of correction $\alpha$1, $\alpha$2, $\alpha$3, and $\alpha$4 is simply processed as the additional amount of correction to the gap correction amount of Table 1, drawing up a new table is unnecessary. Thus, multiple correction tables can be prepared which correspond to the linear speeds of the pair of the transfer rollers 133 by the specification and switched among them according to the linear speed, which makes it possible to flexibly deal with the change in the specification of the product.

TABLE 2

| Maximum amplitude (%) | Minimum amplitude (%) | (Maximum amplitude) − (Minimum amplitude) (%) | Width of fluctuation (s) | Amount of gap correction |
|---|---|---|---|---|
| 0-0.1 | — | 0-0.2 | 0-0.2 | a + $\alpha$1 |
| 0.1-0.2 | 0-0.1 | 0.2-0.4 | 0.2-0.4 | b + $\alpha$2 |
| 0.2-0.3 | 0.1-0.2 | 0.4-0.6 | 0.4-0.6 | c + $\alpha$3 |
| 0.3-0.4 | 0.2-0.3 | 0.6-0.8 | 0.6-0.8 | d + $\alpha$4 |
| . . . | . . . | . . . | . . . | . . . |

Embodiment 2

In Embodiment 1, the gap G between the secondary transfer roller 130R and the second support roller 119-2 is adjusted according to the thickness or the form of the front end of paper to restrain shock jitters. The gap G is adjusted by using detected speed variance from the normal speed of the pair of the transfer rollers 133. In Embodiment 2, the variation from the normal state of the driving current when paper enters into the nip Q of the pair of the transfer rollers 133 is detected and the gap G of the pair of the secondary transfer roller 130R and the second support roller 119-2 is adjusted based on the current variation.

Figure 14:
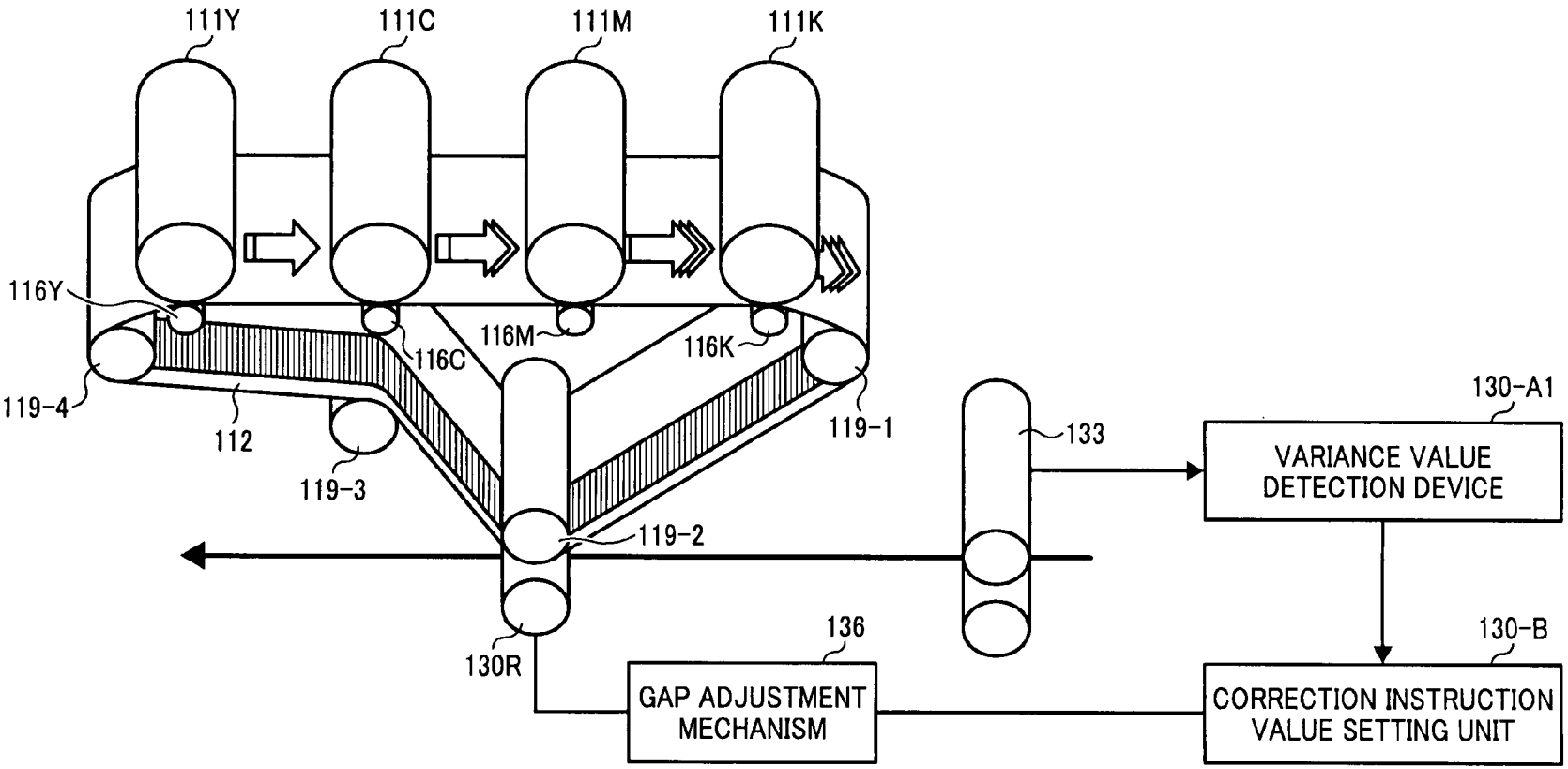
FIG. 14 is a schematic diagram illustrating an example of the secondary transfer portion and the transfer roller portion in Embodiment 2, which is described later.
Figure 15:
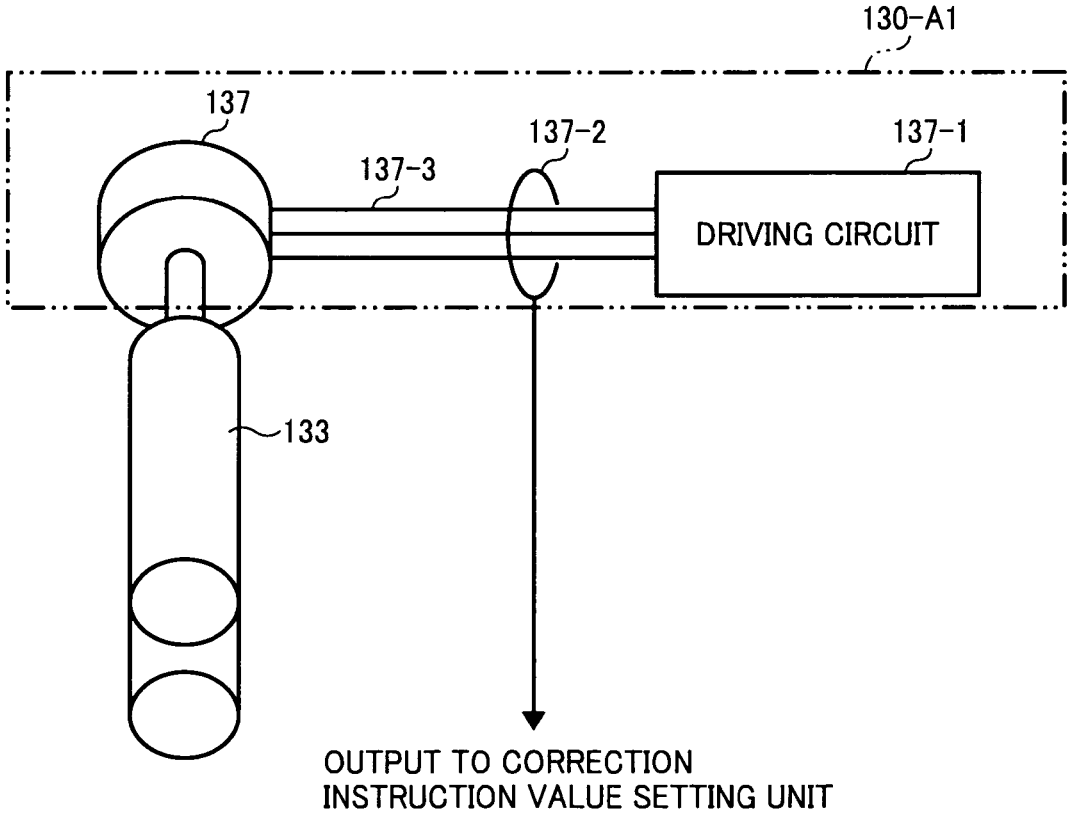
FIG. 15 is a diagram illustrating an example of the variation detection unit in Embodiment 2.

FIG. 14 is a diagram illustrating the schematic of the secondary transfer portion and the transfer roller portion in Embodiment 2. FIG. 15 is a diagram illustrating the variation detection device in Embodiment 2. The same reference numerals as in Embodiment 1 are assigned in Embodiment 2 when the structure portion in Embodiment 2 is significantly the same as that in Embodiment 1 and the description therefor is omitted.

In comparison with the secondary transfer portion 130 and the pair of the transfer rollers 133 in FIG. 3 of Embodiment 1, a driving motor 137 is provided instead of the encoder 135 as illustrated in FIGS. 14 and 15 to drive the pair of the transfer rollers 133. In addition, the variation detection device 130-A in FIG. 5 is replaced with a structure that detects the variance value of the driving current of the driving motor 137. That is, the variance value detection device 130-A1 in Embodiment 2 corresponding to the variation detection device 130A in Embodiment 1 is structured by the driving motor 137 that drives the pair of the transfer rollers 133, a driving circuit 137-1 that drives this driving motor 137, and a current variance value detection unit 137-2 that detects the variation of the driving current of the driving motor 137. The current variance value detection unit 137-2 detects the current of a driving line 137-3 between the driving motor 137 and the driving circuit 137-1, calculates the current variance value by comparing the detected current with the current at the normal state (calculating the difference between the detected current and current at the normal state), and outputs the current variance value to the correction instruction value setting unit 130-B.

Figure 16:
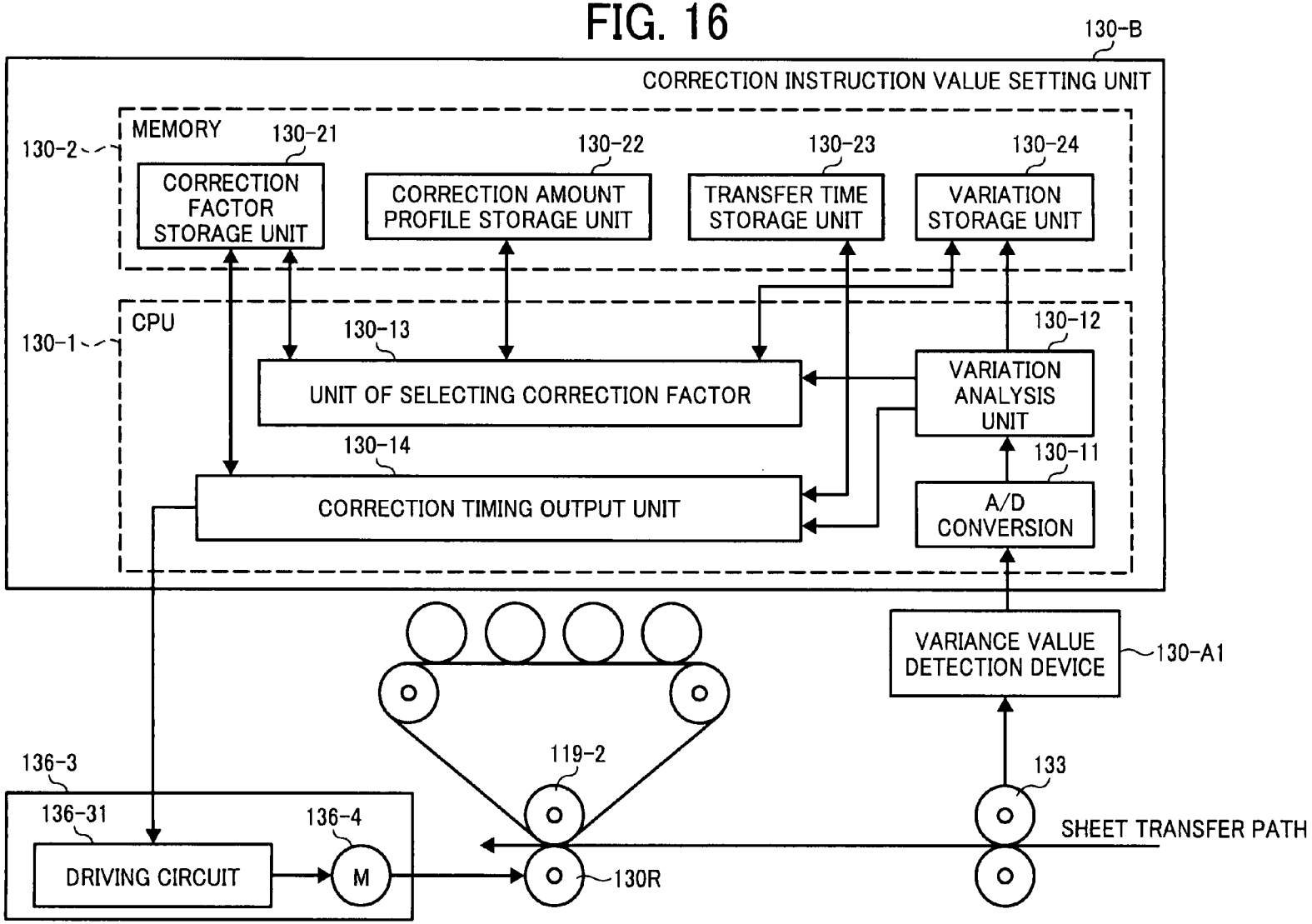
FIG. 16 is a block chart illustrating an example of the detail of the correction instruction value setting unit in Embodiment 2.

FIG. 16 is a block chart illustrating the detail of the correction instruction value setting unit 130-B in Embodiment 2. The correction instruction value setting unit 130-B is formed of a CPU (can be replaced with a control IC) 130-1 and a memory 130-2 as in Embodiment 1. The CPU 130-1 includes an A/D converter 130-11, a variation analysis unit 130-12, a unit of selecting correction factor 130-13, and a correction timing output unit 130-14. The memory 130-2 includes a correction factor storage unit 130-21, a correction amount profile storage unit 130-22, a transfer time storage unit 130-23, and a variation storage unit 130-24.

The variance value of the current detected by the variance value detection device 130-A1 is A/D converted by the A/D converter 130-11. Thereafter, the CPU 130-1 starts processing and performs sampling in synchronization with the timing of the clock of the CPU 130-1. The variation analysis unit 130-12 extracts variance value information required to set the correction amount, uses the amplitude (which is described later) of the extracted variance value to obtain the current variation, and outputs it to the variation storage unit 130-24. The current variation is obtained by the detected current or the current conversion (variance value) from the normal state.

In addition, the start information that indicates a start of analysis is output to the correction timing output unit 130-14. When extraction of the required variation information is complete, the end information is outputs to the correction factor storage unit 103-13.

Figure 17:
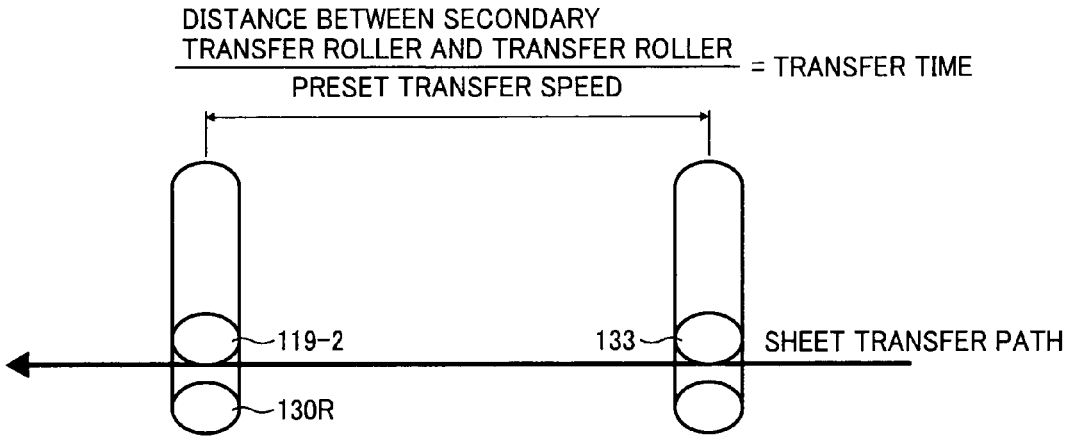
FIG. 17 is a diagram illustrating how to calculate the transfer time in Embodiment 2.

The variation storage unit 130-24 stores the variation information input from the variation analysis unit 130-12 and the correction amount profile storage unit 130-22 stores a profile of the correction amount corresponding to the variation. The transfer time storage unit 130-23 stores the transfer time, which represents a time from when paper has passed through the pair of the transfer rollers 133 to when the paper enters into the secondary transfer roller 130R. The transfer time is a time obtained by calculation from the transfer speed and the preset distance between the nip (contact) portion of the pair of the transfer roller 133 and the nip (contact) portion of the secondary transfer roller 130R and the second support roller 119-2, which is the transfer speed of the pair of the transfer rollers 133 at the normal state (refer to FIG. 17).

The unit of selecting correction factor 130-13 starts comparison between the variation information stored in the variation storage unit 130-24 and the profile stored in the correction amount profile storage unit 130-22 to determine the amount of correction when the end information is input from the variation analysis unit 130-12. The determined or set correction amount is stored in the correction factor storage unit 130-21. The correction timing output unit 130-14 receives the start information from the variation analysis unit 130-12 and reads the determined correction amount from the correction factor storage unit 130-21 after the period of time stored in the transfer time storage unit 130-23; and outputs the correction amount to the driving circuit 136-31 of the driving mechanism 136-3. The driving circuit 136-31 drives the stepping motor 136-4 according to the correction amount input from the correction timing output unit 130-14 to correct the gap G between the transfer belt (the second support roller 119-2) and the secondary transfer roller 130R.

Figure 18:
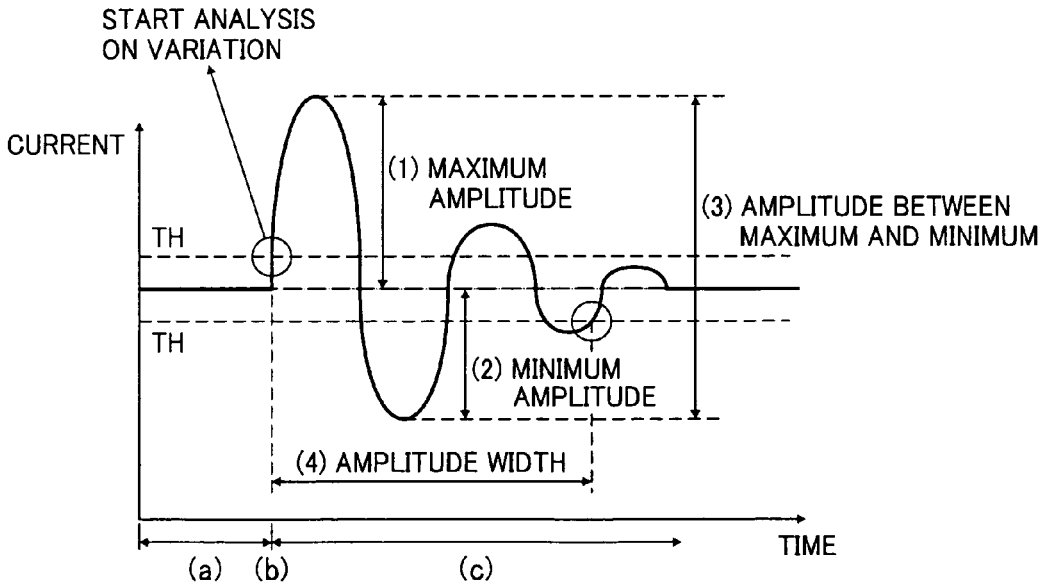
FIG. 18 is a diagram illustrating the status in which the variance of the current of the motor that drives the pair of transfer rollers when paper enters into the nip of the pair of the transfer rollers in Embodiment 2.

FIG. 18 is a diagram illustrating the variance state of the current of the motor 137 that drives the pair of the transfer rollers 133 when paper enters into the pair of the transfer rollers 133 in Embodiment 2. The state in which paper enters into the nip portion of the pair of the transfer rollers 133 is the same as the state illustrated in FIG. 6 in Embodiment 1. (a) represents the state just before the paper enters into the nip, (b) represents the state when the paper enters into the nip, and (c) represents when the paper is transferred while pinched by the pair of the transfer rollers 133. The state (a) illustrated in FIG. 6 corresponds to the time (a) in the horizontal axis in FIG. 18. That is, the paper is transferred at a predetermined constant speed before the paper enters into the nip portion of the pair of the transfer rollers 133. Thus, the motor 136-4 is driven at a predetermined current. Then, as illustrated in FIG. 6(*b*), when the paper is brought into contact with the nip portion of the pair of the transfer rollers 133 and pinched, the speed varies, which increases the current to the maximum side. Then, when the current reaches the maximum amplitude, the current is shaken back to the minimum amplitude. Thereafter, the current fluctuates to the maximum side and to the minimum side relative to the constant speed along with the speed variance and converges to the constant current value. This variation of the current is analyzed by the variation analysis unit 130-12.

In this analysis method, the driving current of the motor 136-4 varies from the constant current when the paper enters into the nip portion as described above. When the variance value from the constant state surpasses a threshold, the paper is judged to have passed the nip portion, which triggers the analysis.

The variance value is the same as the speed variance in Embodiment 1 and the current variations extracted by the current variance are as follows:

(1) the maximum amplitude
(2) the minimum amplitude and
(3) the difference between (1) and (2)

(4) the width (time) of fluctuation (amplitude), of the current variance.

In FIG. 18, the width of fluctuation represents a time between when a signal surpasses a preset threshold and the last time the signal converges from the outside of the preset, threshold within the preset threshold in a preset period of time. The preset threshold is, for example, + or −3% from an ideal speed. The preset period of time is an anticipated time during which the speed changes at the entering of paper. At least this anticipated time is shorter than the time to be taken for a sheet of paper to pass through the nip portion and determined based on experiments. In addition, the variation analysis unit 130-12 outputs information that the analysis on the variation has started and finished.

The current variation corresponds to the parameters of (1) to (4) obtained by the variation analysis unit 130-12 according to the values detected at the variance value detection device 130-A1. Therefore, in this Embodiment, the values prior to input to the variation analysis unit 130-12 are referred to as the variance value and the values after analysis at the variation analysis unit 130-12 are referred to as variation.

Table 3 is an example of the correction table stored in the correction amount profile storage unit 130-22 in Embodiment 2. The correction amount of Gap G is determined by referring to at least one of the current variations of (1) to (3) as in Embodiment 1 and a constant value is output when the variations are within a predetermined range.

TABLE 3

| (1) Maximum amplitude (%) | (2) Minimum amplitude (%) | (3) (Maximum amplitude) − (Minimum amplitude) (%) | (4) Width of fluctuation (s) | Amount of gap correction |
|---|---|---|---|---|
| 0-1 | 0-1 | 0-1 | 0-0.1 | a1 |
| 1-2 | 1-2 | 1-2 | 0.1-0.2 | b1 |
| 2-3 | 2-3 | 2-3 | 0.2-0.3 | c1 |
| 3-4 | 3-4 | 3-4 | 0.3-0.4 | d1 |
| 4-5 | 4-5 | 4-5 | 0.3-0.5 | e1 |
| . . . | . . . | . . . | . . . | . . . |

The maximum amplitude and the minimum amplitude of (1) and (2) are calculated by the following relationship (3):

$$\text{Maximum(Minimum)amplitude}(\%)=\{[(\text{Maximum (Minimum)variation}-\text{Normal state})/\text{Normal state}]\}\times 100 \quad \text{Relationship (3)}$$

(3) of (Maximum amplitude−Minimum amplitude) is calculated by the following relationship (4):

$$(\text{Maximum amplitude}-\text{Minimum amplitude})(\%)=\{[\text{Maximum variation}-\text{Minimum variation}]/\text{Normal state}\}\times 100 \quad \text{Relationship (4)}$$

When this correction table is referred to and only one of the variations is referred to, for example, when the maximum amplitude is 2.5%, the amount of correction is c1 according to the correction table. When multiple variations are referred to, for example, when the maximum amplitude is 2.5% and the width of fluctuation is 0.1 s, the amount of correction based on the maximum amplitude is c1 and the amount of correction based on the width of fluctuation is a1. Thus, the amount of correction is set to be (c1+a1)/2. When this calculation method is not employed, for example, the amount of correction is determined according to the priority assigned to the variations.

Figure 19:
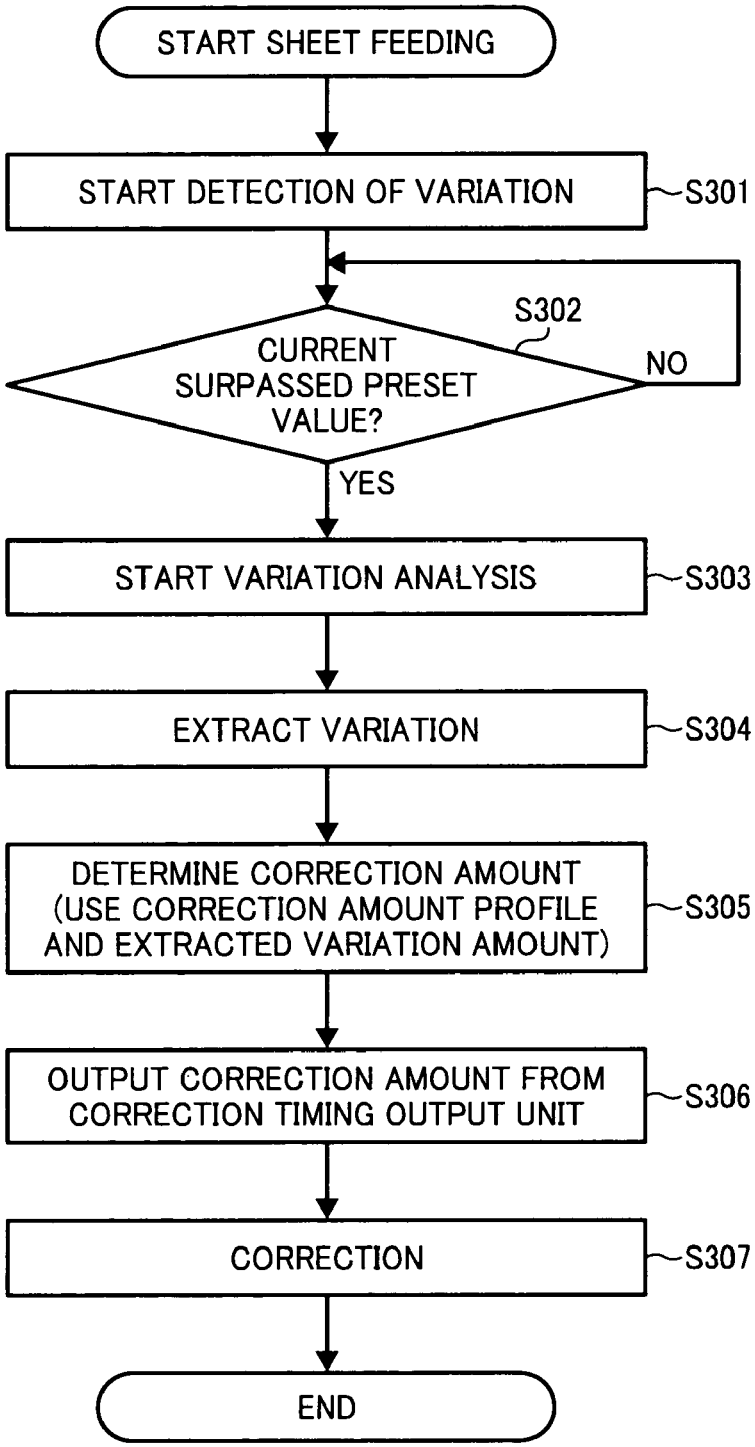
FIG. 19 is flow chart illustrating an example of the processing procedure of the gap adjustment at the secondary transfer portion in Embodiment 2.

FIG. 19 is a flow chart illustrating the processing procedure of the gap adjustment at the secondary transfer portion in Embodiment 2. When paper is fed, the variation detection procedure starts (Step S301). While the variation is monitored, the paper reaches the pair of the transfer rollers 133. When the current at the entering of the paper into the transfer rollers surpasses a threshold TH (refer to FIG. 18) (Step S302), the variation analysis starts (Step S303). In the variation analysis, the variations (the maximum amplitude, the minimum amplitude, maximum amplitude−minimum amplitude and width of fluctuation) described in (1) to (4) are extracted (Step S304).

When the variations are extracted, the correction amount is determined by the variations and the correction table stored in the correction amount profile storage unit 130-22 (Step S305). Then, the correction timing output unit 130-14 outputs the correction amount at a predetermined timing to the driving circuit 136-31 of the driving mechanism 136-3 (Step S306) to correct the gap G (Step S307) at the time of pass-through of the paper.

Figure 20:
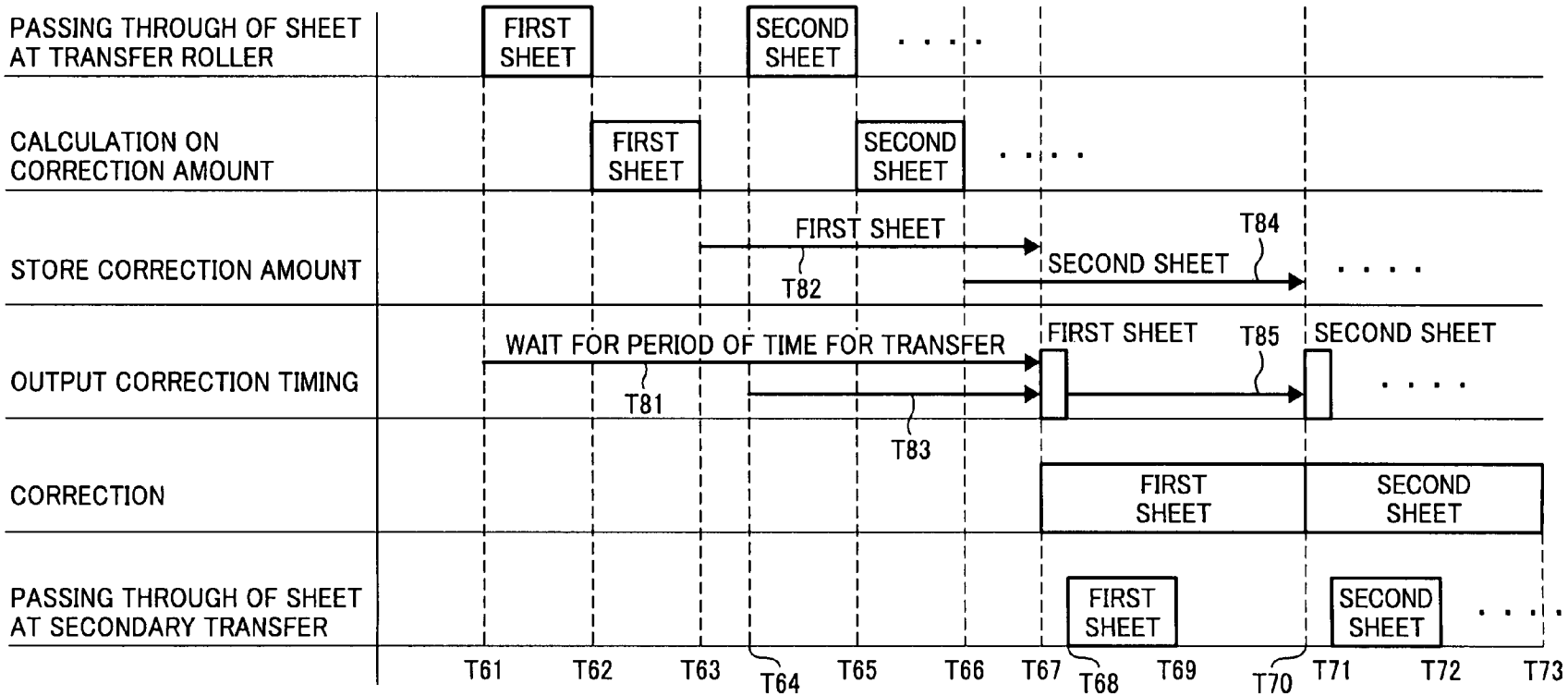
FIG. 20 is a timing chart illustrating an example of the control timing in Embodiment 2.

FIG. 20 is a timing chart illustrating the control timing in Embodiment 2. As seen in this timing chart, the variations are analyzed while the first paper passes through the pair of the transfer rollers 133 (T61 to T62). When the first paper has passed through the nip portion of the transfer rollers 133, the amount of gap correction is calculated (T61 to T63). The calculated correction amount is stored in the correction factor storage unit 130-21 for a certain time of period (T82). The correction timing output unit 130-14 starts to stand by when the analysis by the variation analysis unit 130-11 starts (T61) and keeps on waiting until the paper reaches the secondary transfer roller 130R of the secondary transfer portion 130. When the first paper has passed through the pair of the transfer rollers 133 and the second paper reaches the pair of the transfer rollers 133, the analysis and the calculation of the correction amount are performed (T64 to T66) as in the case of the first paper. The correction amount is held for a predetermined period of time (T84).

The correction timing output unit 130-14 issues an instruction of starting of correction and the correction amount (T67) immediately before the first paper reaches the secondary transfer portion 130. Upon this instruction, the driving circuit 136-31 corrects the gap for the first paper (T67 to T70). During this, the first paper passes through the secondary transfer portion 130 where the secondary transfer is performed (T68 to T69). The correction timing output unit 130-14 issues an instruction of the starting of correction and the correction amount to the driving circuit 136-31 (T70) immediately before the second paper enters into the secondary transfer portion 130 as in the case of the first paper to adjust the gap for the second paper. During this period (T70 to T73), the second paper passes through the secondary transfer portion 130 (T71 to T72). The secondary transfer is performed while in this pass-through of the second paper.

In this Embodiment, the correction value is calculated (T62 to T63) immediately after the pass-through of the first paper to the pair of the transfer rollers 133 (T62). The gap of the secondary transfer roller is adjusted (T67) before the paper reaches the secondary transfer portion 130 (T68). The correction amount is maintained after the pass-through of the paper at the secondary transfer portion 130 until the next correction procedure (T67 to T70). The processing of the first paper between the transfer rollers and gap adjustment (T61 to T67) is interrupted by the next processing (T64 to T67). These two procedures are processed in parallel.

According to this Embodiment, the gap of the secondary transfer portion 130 is adjusted based on the variation of the driving current of the motor 137 that drives the pair of the transfer rollers 133 while the gap adjustment of the secondary transfer portion 130 described in Embodiment 1 is performed by detecting the variation of the transfer speed of the pair of the transfer rollers 133.

The portions not particularly described in Embodiment 2 have the same structures and functions as in Embodiment 1.

Embodiment 3

In Embodiment 3, a paper entering detection sensor 130-PS is added to the structure of Embodiment 2 to detect the entering timing of paper to the secondary transfer portion 130. The gap is adjusted based on this detection timing.

In Embodiment 2, the transfer time storage unit 130-23 stores the transfer time of paper between the pair of the transfer rollers 133 and secondary transfer roller 130R and the correction timing is set based on this transfer time. That is, as illustrated in FIG. 20, the time between when the paper enters into the transfer rollers 133 (T61) and the start of correcting the gap G output by the correction timing output unit 130-14 is based on the stored transfer time described above.

Figure 21:
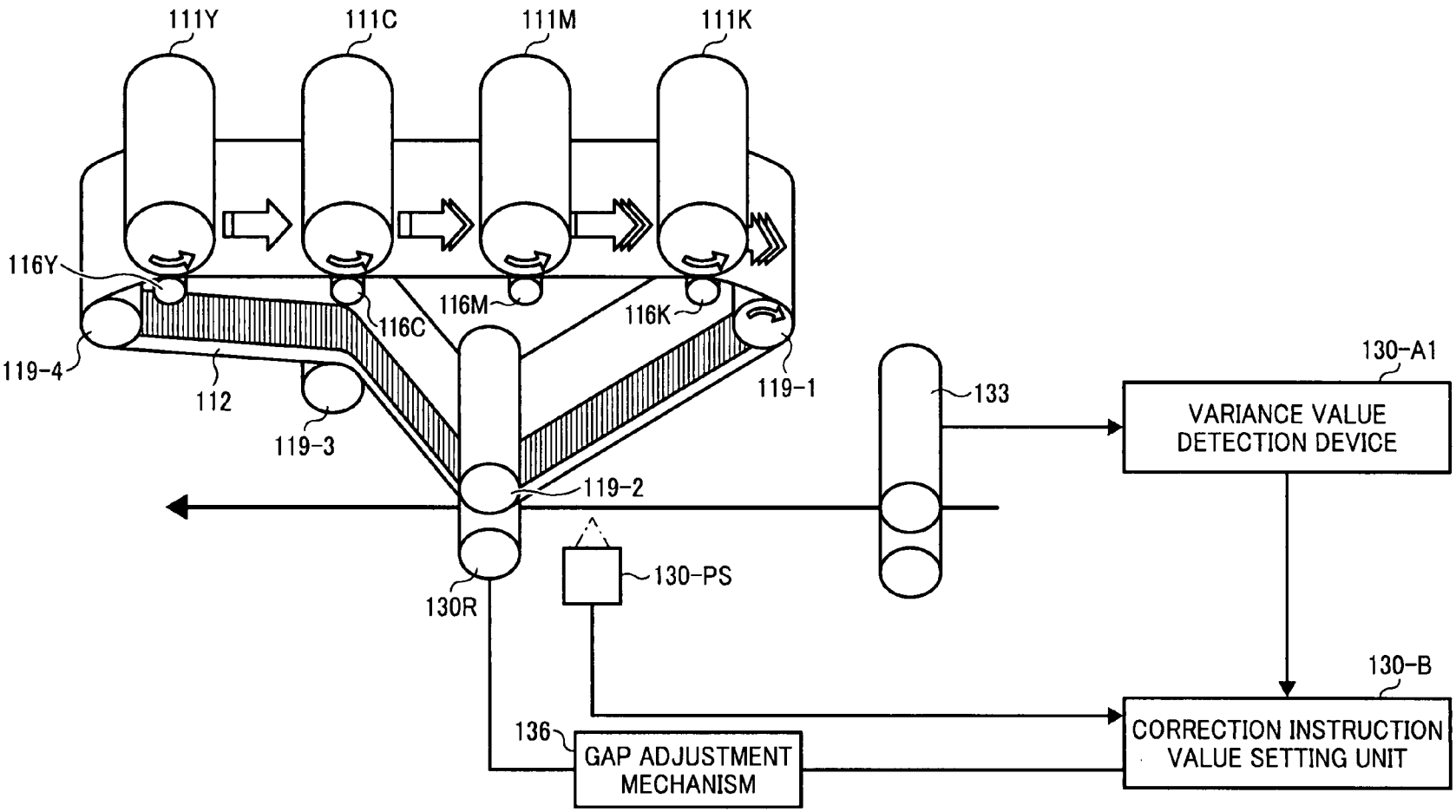
FIG. 21 is a diagram illustrating an example of the structure of variation detection unit in Embodiment 3, which is described later.

In Embodiment 3, as illustrated in FIG. 21, the paper entering detection sensor 130-PS is provided at the position close to the secondary transfer roller 130R on the upstream side thereof relative to the paper transfer direction. The detection signal of the paper entering detection sensor 130-PS triggers the adjustment of the gap G of the secondary transfer portion 130. FIG. 21 is a diagram illustrating the structure of the variation detection device of Embodiment 3. The paper entering detection sensor 130-PS is provided to the structure illustrated in FIG. 14 of Embodiment 2. The other portions of Embodiment 3 are the same as those illustrated in FIG. 15. Therefore, the same descriptions are omitted.

Figure 22:
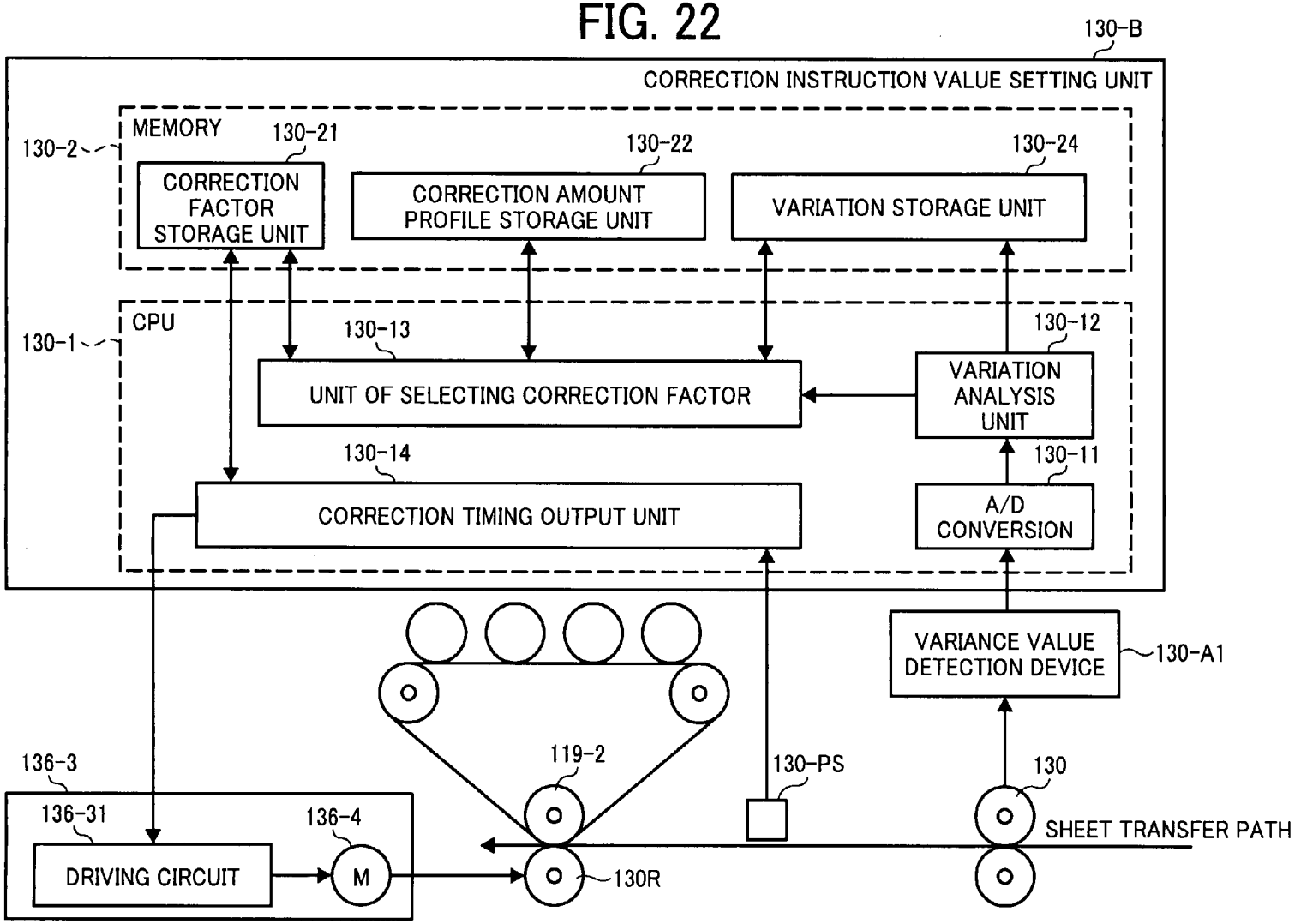
FIG. 22 is a block chart illustrating an example of the detail of the correction instruction value setting unit in Embodiment 3.

FIG. 22 is a block chart illustrating the detail of the correction instruction value setting unit 130-B in Embodiment 3. Embodiment 3 is the same as Embodiment 2 except that the paper entering detection sensor 130-PS is added to the block chart of Embodiment 2 illustrated in FIG. 16 and the transfer time storage unit 130-23 is omitted. Thus, the descriptions of the other portions of Embodiment 3 are omitted.

Figure 23:
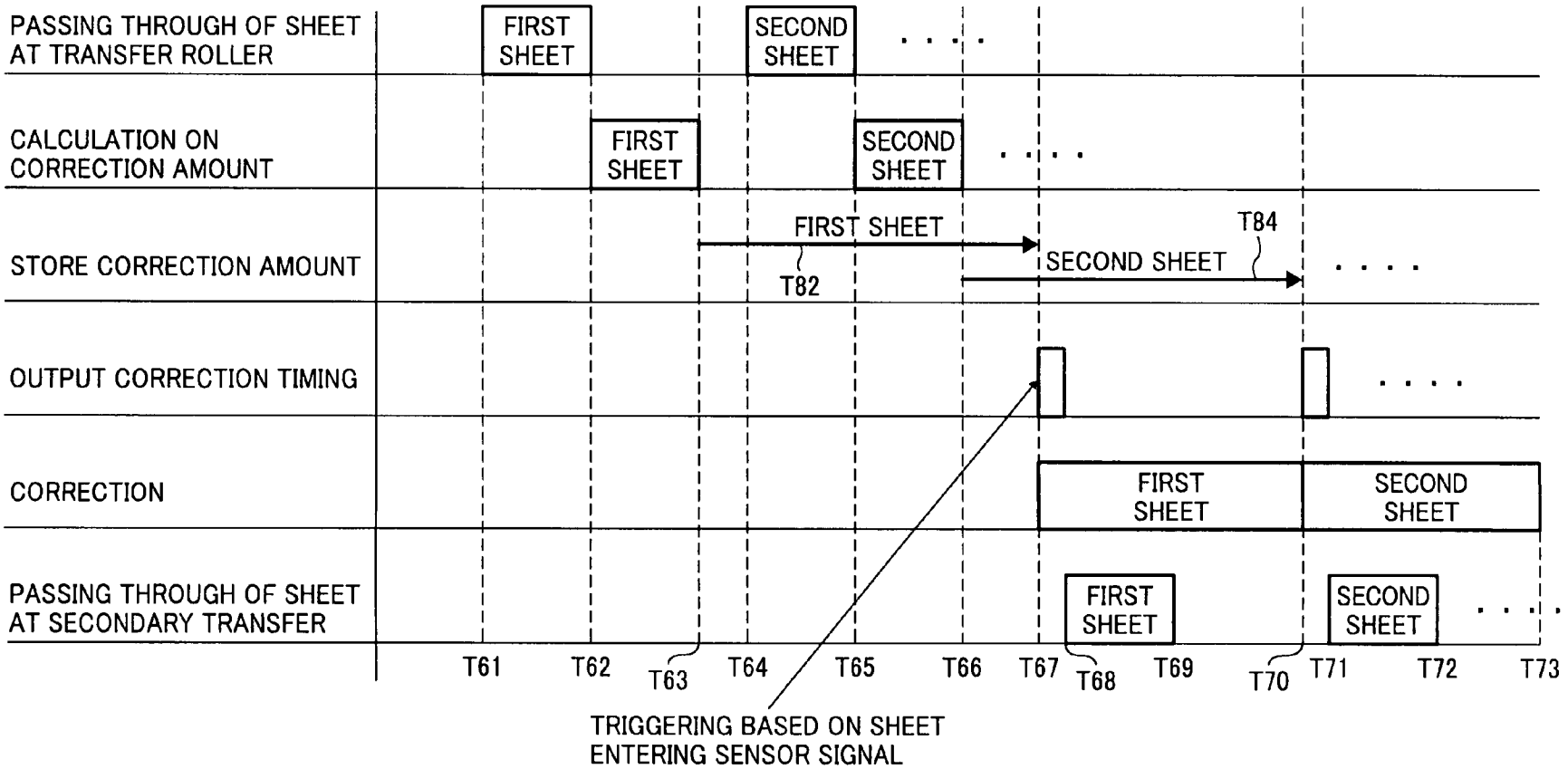
FIG. 23 is a timing chart illustrating an example of the control procedure in Embodiment 3.

FIG. 23 is a timing chart illustrating the control procedure in Embodiment 3. In FIG. 23, as described above, upon receipt of the detection signal of the paper entering detection sensor 130-PS, the correction timing output portion 130-14 issues an instruction of the start of correction with the correction amount (T67) and then the driving circuit 136-31 corrects the gap for the first paper (T67 to T70). Thus, the correction timing output portion 130-14 does not have to wait for the transfer time before starting the correction. As a result, the waiting time of T81, T83 and T85 are unnecessary. The other timings are the same as those illustrated in FIG. 20.

Embodiment 3 is illustrated as a variation of Embodiment 2. The same applies to Embodiment 1 in which the gap at the secondary transfer portion 130 is adjusted by detecting the speed variations.

The portions that are not specifically described have similar structures and functions as described in Embodiment 1 and 2.

Therefore, according to Embodiments, 1) based on the speed variation obtained from the variance value of the transfer speed of the pair of the transfer rollers 133 detected by the encoder 135, or the variation of the driving current of the motor 137 that drives the pair of the transfer rollers 133 detected by the current variance value detection unit 137-2, the roller gap is adjusted when paper enters into the secondary transfer portion 130 according to this variation, and therefore, the gap is adjusted paper by paper with regard to thickness, stiffness, form of the front end of paper, etc. Therefore, the shock jitter is securely and accurately restrained;
2) since the gap adjustment is performed on the detected speed variance and obtained correction amount and the correction amount is stored in a table, the gap is rapidly adjusted;
3) since the correction amount is set based on the variation of speed variance or the variation of the driving current of the motor 137 that drives the pair of the transfer rollers 133 and the variation can be calculated from the maximum amplitude, the minimum amplitude or the difference therebetween, the calculation is easily made so that the gap adjustment is easily performed paper by paper;
4) since the table for the correction amount is prepared for the predetermined linear speed of the pair of the transfer rollers 133 and switched according to the linear speed, making correction amount tables is easy and calculation is also easily performed; and
5) the present invention can be applied to the secondary transfer device that secondarily transfers images with the intermediate transfer belt 112 regardless of monochrome or multicolor images.

This document claims priority and contains subject matter related to Japanese Patent Applications Nos. 2008-196495 and 2009-160017, filed on Jul. 30, 2008, and Jul. 6, 2009, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An intermediate transfer device comprising:

an intermediate transfer body comprising a primary transfer portion and a secondary transfer portion which is configured to bear a secondary image formed by transferring a primary image from an image bearing member;

a pair of secondary transfer rollers comprising a secondary transfer roller and a support roller provided in contact with each other via the intermediate transfer body at the secondary transfer portion, the pair of secondary transfer rollers being configured to transfer the secondary image to a recording medium at the secondary transfer portion;

a variation detection device configured to detect an amount of variance occurring to a transfer rotation body when the recording medium is transferred to the secondary transfer portion, the amount of variance being a speed variation of the transfer rotation body or a variation of a driving current of a motor that drives the transfer rotation body; and an adjustment device configured to adjust a distance between the pair of the secondary transfer rollers according to the amount of variance detected by the variation detection device, the adjustment device including a storage device in which a correction amount for use in adjustment of the distance is stored in at least one table, the at least one table for the correction amount is prepared per preset speed of the one pair of the at least one pair of transfer rotation bodies and is switched according to the speed.

2. The intermediate transfer device according to claim 1, wherein the distance is defined as a distance between a center of the secondary transfer roller and a center of the support roller.

3. An image forming apparatus comprising:

an image bearing member configured to bear a primary image;

a primary transfer device;

an intermediate transfer body comprising a first transfer portion and a secondary transfer portion, the intermediate transfer body being configured to bear a secondary transfer image formed by transferring the primary image from the image bearing member by the primary transfer device at the first transfer portion;

a pair of the secondary transfer rollers comprising a secondary transfer roller and a support roller provided in contact with each other at the secondary transfer portion via the intermediate transfer body, the pair of secondary transfer rollers being configured to transfer the secondary image to a recording medium at the secondary transfer portion;

at least one pair of transfer rotation bodies configured to transfer the recording medium to the secondary transfer portion;

a variation detection device configured to detect an amount of variance occurring to one pair of the at least one pair of transfer rotation bodies when the recording medium is transferred to the secondary transfer portion, the amount of variance being a speed variation of the one pair of the at least one pair of transfer rotation bodies or a variation of a driving current of a motor that drives the one pair of the at least one pair of transfer rotation bodies; and an adjustment device configured to adjust a distance between the pair of the secondary transfer rollers according to the amount of variance detected by the variation detection device, the adjustment device including a storage device in which a correction amount for use in adjustment of the distance is stored in at least one table, the at least one table for the correction amount is prepared per preset speed of the one pair of the at least one pair of transfer rotation bodies and is switched according to the speed.

4. The image forming apparatus according to claim 3, wherein the distance is defined as a distance between a center of the secondary transfer roller and a center of the support roller.

5. The image forming apparatus according to claim 3, wherein the variance is represented by a speed changed from a normal rotation speed of the one pair of the at least one pair of transfer rotation bodies.

6. The image forming apparatus according to claim 3, wherein the amount of variance is represented by an amplitude from a steady state.

7. The image forming apparatus according to claim 3, wherein the amount of variance is represented by a time from a start of variance to back to normal.

8. The image forming apparatus according to claim 3, wherein the amount of variance is represented by a maximum amplitude from a normal status.

9. The image forming apparatus according to claim 3, wherein the amount of variance is represented by a minimum amplitude from a normal status.

10. The image forming apparatus according to claim 3, wherein the secondary image is a monochrome image.

11. The image forming apparatus according to claim 3, wherein the secondary image is a multi-color image.

12. A secondary transfer method comprising:

transferring a primary image to an intermediate transfer body by a primary transfer device to form a secondary image;

transferring the secondary image to a recording medium at a secondary transfer portion of the intermediate transfer body by a pair of secondary transfer rollers comprising a secondary transfer roller and a support roller;

transferring the recording medium to the secondary transfer portion by at least one pair of transfer rotation bodies;

detecting an amount of variance occurring to the at least one pair of transfer rotation bodies when transferring the recording medium to the secondary transfer portion, the amount of variance being a speed variation of the transfer rotation body or a variation of a driving current of a motor that drives the one pair of the at least one pair of transfer rotation bodies; and adjusting a distance between a center of the secondary transfer roller and a center of the support roller, storing in at least one table in a storage device, a correction amount for use in adjustment of the distance;

preparing the at least one table for the correction amount per preset speed of the one pair of the at least one pair of transfer rotation bodies, and switching the table according to the speed.

* * * * *